US009085975B2

(12) United States Patent
Abad

(10) Patent No.: US 9,085,975 B2
(45) Date of Patent: Jul. 21, 2015

(54) METHOD OF TREATING A SUBTERRANEAN FORMATION AND FORMING TREATMENT FLUIDS USING CHEMO-MATHEMATICAL MODELS AND PROCESS CONTROL

(75) Inventor: Carlos Abad, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 644 days.

(21) Appl. No.: 12/718,535

(22) Filed: Mar. 5, 2010

(65) Prior Publication Data

US 2010/0224365 A1 Sep. 9, 2010

Related U.S. Application Data

(60) Provisional application No. 61/209,527, filed on Mar. 6, 2009.

(51) Int. Cl.
*E21B 43/267* (2006.01)
*E21B 43/16* (2006.01)
*E21B 43/26* (2006.01)

(52) U.S. Cl.
CPC ..... *E21B 43/26* (2013.01)

(58) Field of Classification Search
USPC ..... 166/308.1, 305.1, 308.2, 308.3, 308.5, 166/275
See application file for complete search history.

(56) References Cited

U.S. PATENT DOCUMENTS 4,828,034 A * 5/1989 Constien et al. ..... 166/308.4
4,845,981 A * 7/1989 Pearson ..... 73/152.31
4,901,563 A * 2/1990 Pearson ..... 73/152.31
5,056,598 A * 10/1991 Jennings, Jr. ..... 166/308.1
5,431,227 A * 7/1995 Montgomery et al. ..... 166/307
5,799,734 A * 9/1998 Norman et al. ..... 166/278
6,196,314 B1 * 3/2001 Chen ..... 166/275
6,320,820 B1 * 11/2001 Gardner et al. ..... 367/81
6,367,548 B1 * 4/2002 Purvis et al. ..... 166/281
6,724,687 B1 * 4/2004 Stephenson et al. ..... 367/32
6,851,444 B1 * 2/2005 Kohl et al. ..... 137/13
6,876,959 B1 4/2005 Peirce et al.
7,082,993 B2 * 8/2006 Ayoub et al. ..... 166/250.1
7,090,017 B2 * 8/2006 Justus et al. ..... 166/308.1
7,391,675 B2 * 6/2008 Drew ..... 367/73
7,509,245 B2 3/2009 Siebrits et al.
7,660,199 B2 * 2/2010 Drew ..... 367/40
2004/0168811 A1 * 9/2004 Shaw et al. ..... 166/368
2005/0166961 A1 * 8/2005 Means et al. ..... 137/13
2005/0194139 A1 * 9/2005 Hanes et al. ..... 166/278
2006/0062084 A1 * 3/2006 Drew ..... 367/68
2007/0007681 A1 * 1/2007 Chevillard et al. ..... 264/40.1
2007/0137860 A1 * 6/2007 Lovell et al. ..... 166/250.01

(Continued)

*Primary Examiner* — Kenneth L Thompson
(74) *Attorney, Agent, or Firm* — Jeremy D. Tillman; Rachel E. Greene

(57) ABSTRACT

A method of treating a subterranean formation penetrated by a wellbore is carried out by preparing a treatment fluid at a surface location based upon an initial model of fluid properties for the treatment fluid. The treatment fluid is formed from a first fluid stream and at least one additive fluid stream that are combined to form a treatment fluid stream that is introduced into the wellbore in a substantially continuous process. A fluid property of at least one of the streams is monitored while forming the treatment fluid to provide at least one monitored fluid property of the at least one of the streams. The model is updated based upon the at least one monitored fluid property during the substantially continuous process. Optionally, at least one of the first fluid stream and the at least one additive stream is adjusted as necessary based upon the updated model.

18 Claims, 24 Drawing Sheets

(56) References Cited

U.S. PATENT DOCUMENTS

2008/0203199 A1* 8/2008 Serafin et al. ..... 241/5
2009/0023614 A1* 1/2009 Sullivan et al. ..... 507/214
2009/0255729 A1* 10/2009 Georgi et al. ..... 175/24
2010/0059226 A1* 3/2010 Termine et al. ..... 166/308.1

* cited by examiner

METHOD OF TREATING A SUBTERRANEAN FORMATION AND FORMING TREATMENT FLUIDS USING CHEMO-MATHEMATICAL MODELS AND PROCESS CONTROL

CROSS-REFERENCE TO RELATED APPLICATIONS

This application claims the benefit of U.S. Provisional Application No. 61/209,527, filed Mar. 6, 2009, which is incorporated herein by reference in its entirety.

BACKGROUND

The statements in this section merely provide background information related to the present disclosure and may not constitute prior art.

Treatment fluids used for treating subterranean formations in oil and/or gas wells are typically prepared at a surface location and pumped downhole through the well into the formation. Examples of treatments for subterranean formations are hydraulic fracturing, matrix acidizing, wellbore consolidation, gravel pack treatments, frac and pac treatments, well abandonment treatments, cementing treatments, wellbore clean-out operations, water control treatments, wellbore consolidation or wellbore strengthening treatments, and the like. One particular example of such a treatment is hydraulic fracturing. In one mode of operation, hydraulic fracturing is a process for stimulating oil and gas wells by pumping a hydraulic fracturing fluid formed as a viscosified slurry containing sand or proppant at high pressure into producing rock layers so that the formation is fractured or cracked. Once the rock is cracked, the resulting fracture is propped open by the proppant or sand carried by the slurry after the pressure is reduced. This propped fracture serves as a highly conductive path for the oil or gas, and therefore increases the effective producing well-bore radius. Fluid viscosity is vital for effective proppant placement during fracturing operations. Polysaccharides such as guar and guar derivatives have historically served as the most common viscosity enhancers. These polymers are often crosslinked using borates or metallic crosslinkers such as zirconium and titanium to generate even higher viscosity. For each fluid formulation, viscosity is predicted prior to pumping by tests performed during the fluid development phase. These results are typically reproduced with matching conditions (same lots of chemicals, same mix-water, same breaker concentrations and same well bottom-hole static temperature) prior to the treatment and adjustments are made when needed. Qualitative pre job quality assurance/quality control (QA/QC) is performed on location before beginning the pumping operation to ensure the fluid performs as required.

A major challenge in hydraulic fracturing operations and other treatments is how to ensure that the fluid that is being pumped matches the performance it was designed for. A limited number of samples of the fluid may be manually taken at significant events to ensure they match the fluid design, but this is only done periodically or sparsely. Additionally, treatment and/or fluid variables may have changed between the time the fluid is formed and pumped and the time the fluid sample is taken so that the properties of the actual treatment fluid no longer matches exactly those of the designed treatment fluid.

As an example, mix water used in forming the treatment fluid may contain an amount of iron. Iron can have a significant impact on the properties of the treatment fluid. The iron concentration of the water may therefore be measured prior to forming the treatment fluid to determine how much iron control agent must be added to the fluid. In certain cases, the iron concentration of the water may be measured hours or even days before the treatment fluid is formed. Preparation and design of the treatment fluid may be made based upon this measured iron concentration. When the treatment fluid is pumped, however, the iron concentration may have changed due to additional iron from tanks, pipes, etc. leaching into the water. Thus, the amount of iron control agent additive designed for the treatment may no longer be sufficient. Additionally, because the treatment is conducted as a continuous process with fluids being combined and mixed in a continuous flow as the treatment is carried out, the amount of iron in the water may change over time for various reasons. The properties of the iron control agent added to the treatment fluid may also change over time if a different lot is used during the treatment than what was used in the initial design. As can be seen, the treatment fluid properties of the initial design may no longer match the properties as they exist because of these changes.

Other variables that can have a considerable impact on the fluid performance and that can vary from frac tank to frac tank, or in time are enzyme concentration, bacteria count, active biocide concentration, water hardness (as $Ca^{2+}$ or $Mg^{2+}$ concentration), bicarbonate or carbonate concentration, pH, or mix water temperature.

In most cases, once the treatment has begun, there is very little monitoring of the fluid properties of the various treatment fluid components or the treatment fluid itself or adjusting the composition of the treatment fluid once the treatment has begun. If any are made, these are only sparse or periodic measurements. Typically, feedback regarding the treatment fluid properties is obtained through fluid pressure responses that are measured during the treatment. These measurements may have little to do with the properties of the treatment fluid and may have more to do with the response of the formation and properties of the well or completion. Thus, the treatment fluid formulation may be changed in response to a formation event, when it should have remained unaltered. Conversely, a friction change attributable to a fluid composition change could be mistakenly attributed to formation events and as a response a treatment may be shut down early, while a small formulation adjustment would have been the appropriate response. Therefore it is difficult to tell what has caused the change and whether it is a result of a property of the fluid or some other factor, without some appropriate monitoring or prediction of fluid properties.

Accordingly, a need exists for providing a method of performing a treatment and monitoring and controlling a treatment fluid wherein properties of the treatment fluid and its components can be monitored and taken into account to provide a more effective treatment fluid and treatment.

SUMMARY

A method of treating a subterranean formation penetrated by a wellbore is carried out by preparing a treatment fluid at a surface location based upon an initial model of fluid properties for the treatment fluid. The treatment fluid is formed from a first fluid stream and at least one additive fluid stream that are combined to form a treatment fluid stream that is introduced into the wellbore in a substantially continuous process. In certain embodiments there may be a plurality of additive streams. A fluid property of at least one of the streams is monitored while forming the treatment fluid to provide at least one monitored fluid property of the at least one of the streams. The model is updated based upon the at least one monitored fluid property during the substantially continuous process. Optionally, at least one of the first fluid stream and the at least one additive stream is adjusted as necessary based upon the updated model.

In certain embodiments, the monitoring of at least one of the streams may be conducted substantially continuously or monitoring of at least one of the streams may be conducted periodically using dynamic rheology analysis. The dynamic rheology analysis may be conducted off-line or on-line. Where monitoring of the fluid property of the at least one of the streams is carried out periodically, a prediction of a fluid property for at least one of the fluid streams may be provided based upon fluid modeling and the periodically monitored fluid property and providing an estimate of a fluid property for at least one of the fluid streams. At least one of the first fluid stream and the at least one additive stream may be adjusted based upon a comparison of the updated model and the estimate of the fluid property.

In certain specific embodiments, the treatment fluid may be selected from one of a hydraulic fracturing fluid, an acid fracturing fluid, an acid diverting fluid, a matrix acidizing fluid, a sandstone acidizing fluid, a sand control treatment fluid, a wellbore consolidation treatment fluid, a cementing treatment fluid, a water control treatment fluid, a remediation treatment fluid, a polymer fracturing fluid, a crosslinked polymer fracturing fluid, a foamed fracturing fluids, an emulsion fracturing fluid, a slick water fracturing fluid, a bull heading acid formulation, an organic clay acid treatment fluid, a sand consolidation treatment fluid, and a diversion treatment fluid.

The at least one additive fluid stream may be selected from at least one of a viscosifying agent stream, a proppant stream, a crosslinking agent stream, a crosslinking activator stream, an oxygen scavenging stream, a crosslinking delay agent stream, a solid polymer stream, a slurried polymer stream, a resin stream, a fines migration additive stream, a fiber stream, a resin coated proppant stream, a corrosion inhibitor stream, a friction reducer stream, a clay control additive stream, an organic scale control stream, a flow back additive stream, a microemulsion stream, a foamer stream, a gas stream, an immiscible liquid stream, an acid, a base, a chelating agent, a wetting agent, a viscoelastic surfactant gelling stream, a diverter stream, a breaker activator, a breaker retarder, a biocide, and a breaker stream.

The monitored fluid property may include at least one of pH, temperature, simple shear viscosity, complex viscosity, loss modulus, complex modulus, elastic modulus, loss tangent, tan δ, fluid density, chemical composition, flow rate, addition rate, additive concentration, degree of crosslinking, additive molecular weight, onset temperature for crosslinking, fluid thermal thinning, proppant settling velocity, pressure, UV, IR, NIR, and Raman spectroscopic measurements.

Monitoring of the fluid property may occur at least one of a point of introduction of a fluid stream, an outlet, a point of mixing of at least two different fluid streams, the well head, a selected depth within the wellbore, a perforated zone of the wellbore and a position within a fracture of the subterranean formation.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
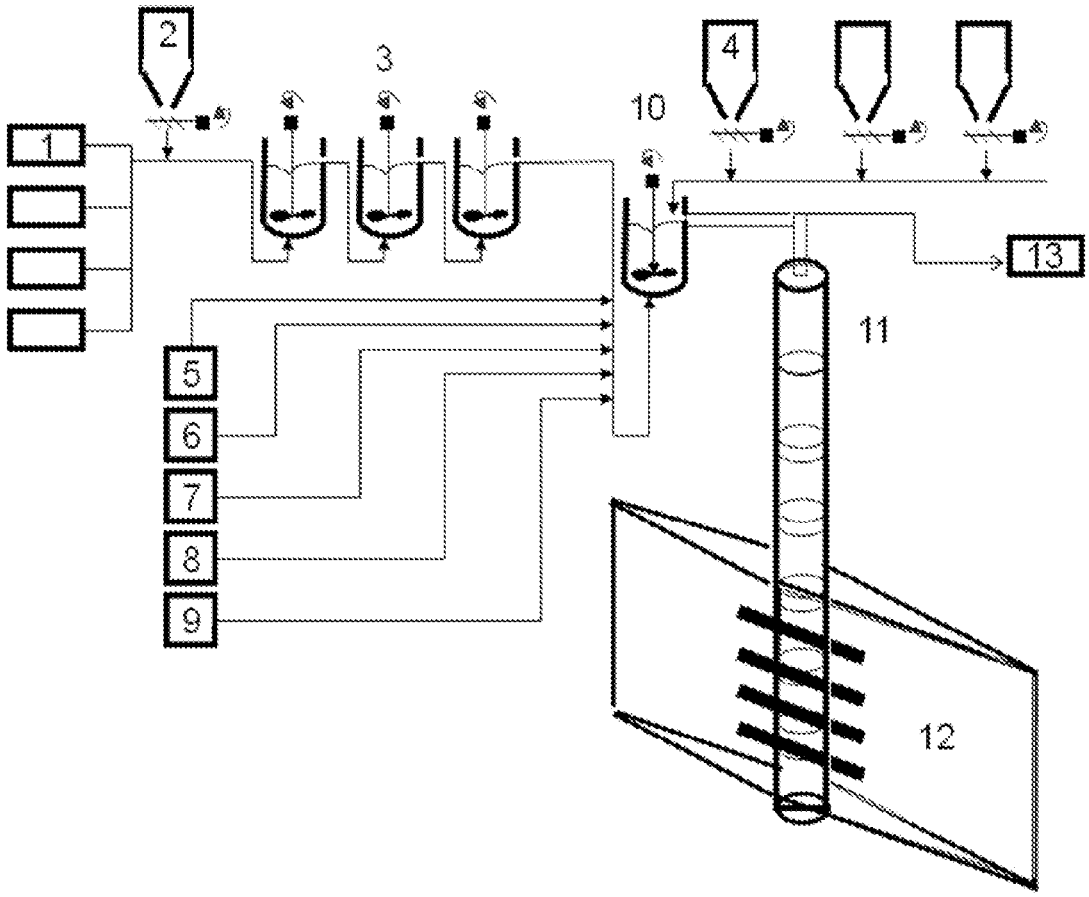
FIG. 1 is a schematic flow diagram of a typical hydraulic fracturing treatment.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled.

It should also be noted that in the development of any such actual embodiment, numerous decisions specific to circumstance must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention has application to methods of treating subterranean formations that are penetrated by a wellbore of a well with a treatment fluid. Typically the well is a hydrocarbon producing well, such as an oil or gas well, but may have application in other areas, such as water wells and the like. The treatment fluid may be any treatment fluid wherein different components of the treatment fluid are mixed at one location, such as the surface, and pumped downhole. While the present invention has particular application to hydraulic fracturing operations, it may have application to other applications as well, such as acid fracturing, an acid diverting fluid treatment, matrix acidizing, sandstone acidizing, sand control treatments, wellbore consolidation treatments, cementing treatments, water control treatments, remediation treatments, or any other oilfield treatment where a chemical reaction or a chemical or physical process takes place. Thus, while the following description may be directed primarily to hydraulic fracturing, it should be understood that the description may apply to other well servicing treatments as well.

Hydraulic fracturing has typically been viewed as a simple blending process of proppant and a carrier fluid to be pumped into a reservoir formation. In reality, however, hydraulic fracturing chemical processes are not that simple. A fracturing treatment can be considered as a semi-batch or substantially continuous polymerization or chemical plant with multiple unit operations. In one mode of operation of particular interest for the invention, the process encompasses dissolving and pumping a polymer viscosifier in an aqueous solvent, the quality of which may vary from one location to another or from a stock tank (e.g. frac tank) to another. For a treatment, each tank may be crosslinked with a different recipe. For a highly successful treatment, it is necessary that all variables in the process be well controlled. Those skilled in the art will recognize that produced water, flow back water, and pond water, among others, are sources of water that may be used in the industry that can vary significantly in quality from one place to another and from one time to another. For other cases where the raw material source is not completely controlled, the variations in such sources can be considered as noise for the treatment formulation. Accordingly, the present invention has application to such situations. In the present invention, the flow rate of each chemical stream (solid, liquid or gas) may be metered and controlled in a closed loop, and its set point can be modified. Control may be conducted manually or remotely, such as by means of an electrical signal.

A common Quality Assurance and Quality Control QA/QC practice on location is to formulate the fluid using the lots of chemicals brought to the wellsite, for instance by selecting water from a few frac tanks. Unfortunately this on-site QA/QC cannot take into account all possible random variable changes and their interactions that the fluid will be formulated with during the pumping schedule.

Referring to FIG. 1, a simplified example of some of the elements of a typical fracturing operation are shown. It should be understood that other configurations of process flow and equipment may be used that differ from that shown. As shown, fracturing tanks 1 are used to hold a solvent or carrier fluid stream used in preparing the treatment fluid. The solvent stream is typically a mix water used for the treatment fluid and may include an aqueous fluid such as fresh water, city water, river water, lake water, pond water, flow back water, produced water, re-used water, sea water, salt solutions or brines, although the solvent or carrier fluid may include other fluids, aqueous or non-aqueous.

Various additive streams may be combined with the solvent, carrier fluid or mix water. For a hydraulic fracturing fluid this includes a viscosifying agent stream designated at 2. The viscosifying agent stream may be a hydratable polymer, such as guar or other polysaccharide derivative. Viscoelastic surfactants may also be used as the viscosifying agent. A mixing unit 3 may be provided for mixing the solvent and the viscosifying agent. The mixing unit 3 may be in the form of a series of continuously stirred hydration tanks, or just as a series of residence time tanks Various solid material streams 4 for delivering sand, fibers, proppant, resin coated proppant, resins, encapsulated breakers (such as those that may be released by fracture closure or other mechanisms) or other particulate matter may also be provided and metered in selected amounts from a metering unit.

Other additive streams may also be combined with the fluid streams to form the treatment fluid. These may include a crosslinker stream 5 that is used to facilitate crosslinking of the polymer viscosifying agent. Other additives may include a crosslinker activator stream 6, an oxygen scavenger stream 7, a crosslinker delay agent stream 8 and a breaker stream 9. The breaker stream 9 may include a live breaker, which may be dissolved in an aqueous medium, and/or be a slurry of an encapsulated or delayed diffusion breakers. Other additional additives may include pH buffers, iron control agents, clay control agents, scale control additives, fine control additives, friction reducers, biocides, flow back additives, pH buffers, gas components, etc. In the interest of operational simplicity and treatment robustness, several of these additives can be incorporated as a pre-blend and delivered as a single stream. An optimum number of streams could be identified for each treatment, which may minimize delivery related variance, but in return, still allows for sufficient level of tailoring and control of the formulation. It should be apparent that other additive streams may also be used. The type of additive streams may vary depending upon the type of treatment and the treatment fluid to be used.

Typically the rate of addition for each of the fluid or solids streams is locally controlled by means of a "closed loop" algorithm such as a PID (Proportional Integral Derivative) control algorithm. For instance, for liquids, a rate measurement (e.g. liquid flow rate measured by means of a mass flowmeter) is compared to the desired set point and an electronic signal of the function of the difference (error) is sent to a metering pump, which can vary its pumping rate accordingly in order to minimize the error function. For solids, a rate measurement (e.g. loss of weight measured by means of a load cell) is compared to the desired set point and an electronic signal of the function of the difference (error) is sent to a screw feeder, which can vary its rotating speed accordingly, in order to minimize the error function.

Alternatively, the addition rate of each of the fluids or solids streams is locally controlled by means of an "open loop" strategy. For instance, for liquids, the flow rate may be controlled by sending an electronic signal to a metering pump, following a predetermined calibration curve of the flow delivered by the pump as a function of the input electronic signal. For solids, the addition rate may be controlled by sending an electronic signal to a screw feeder, following a predetermined calibration curve of the rate delivered by the feeder as a function of the input electronic signal.

In both cases (closed loop and open loop control strategies), prior to the job execution, the addition rate or the calibration constants are verified to ensure that the equipment is functional by physically double checking the liquid or solid addition rate delivered by the system in a given time frame at a set rate.

The desired rate of addition of each of the additives (set point) can be modified at will, following a predetermined trajectory (constant or variable in time per design) or as a result of a required adjustment during the job. The term trajectory as used in this application, relates to the predetermined (open loop) time evolution of a variable throughout a job.

As shown in FIG. 1, a blender 10 may be provided to mix the various components and additives of the treatment fluid. The blender 10 may be a continuous high-speed blender that continuously blends the various fluid streams to form the treatment fluid. Other equipment, not shown in the simplified schematic of FIG. 1, may also be provided, such as pumps, mix tanks, etc. required to facilitate the preparation and delivery of the fluid streams and the treatment fluid may also be provided.

After blending the various components and additives of the treatment fluid, the formed treatment fluid stream is delivered to and introduced into the wellbore 11 of the well. After introduction of the treatment fluid into the wellbore, the wellbore may essential act as a tubular reactor where the components of the treatment fluid interact and cause a change in the properties of the treatment fluid, such as viscosity, temperature, density, pressure, etc.

The hydraulic fracturing or treatment fluid is eventually delivered through the wellbore 11 to the zone of interest 12, which may include a hydraulic fracture. The volume and area of the fractured zone may vary as the treatment fluid is pumped into the fracture. Volume and area can be estimated by comparison of the amount of fluid pumped to the amount of fluid leaking into the formation. The treatment is carried out in a substantially continuous process wherein the treatment fluid is formed and is continuously pumped or introduced into the wellbore. As used herein, the expression "substantially continuously" with respect to the treatment is meant to encompass those situations where pumping or fluid flow is otherwise continuous but may be halted temporarily and then resumed for various reasons during a treatment.

After the treatment is completed the broken fluid is flowed back to a flow back tank 13. The effectiveness of the treatment depends on how this last stage is performed, since polymer degradation and fracturing fluid flow back facilitate the proppant pack clean up, which is the ultimate goal of the treatment. The treatment is typically designed prior to the execution. Often the design is optimized on location based on a re-evaluation of formation parameters such as breakdown pressure, or fluid loss rate obtained through a pre-job pumping (datafrac or minifrac). For the design, appropriate design software may be used.

In the present invention, the various additive streams may comprise variables that can be readily controlled during preparation of the treatment fluid. As discussed these may include the polymer or viscosifying agent, the crosslinker, the delay agent, the activator, the oxygen scavenger, the proppant, the breaker, etc. The concentration of each of these components or additives can be controlled by regulating the flow rate of the additive stream, and by selecting appropriate compositions for the concentrated raw materials. This facilitates and ensures that the fluid formulation performs well live during a treatment as initially planned during the design and lab planning.

During a polymer-based cross-linked fluid fracturing treatment, multiple physical and chemical processes take place that result in the fluid's ability to open, and propagate the fracture, transport and place the proppant, and break and flow back the fluid. A few non-limiting examples of these processes are: elimination of bacteria, precipitation or chelating of metal ions, degradation or deactivation of enzymes, adjustment of the optimum pH for hydration, polymer dispersion, polymer hydration, linear viscosity development, low temperature crosslinker dispersion, low temperature crosslinker dissolution, low temperature crosslinker complexing with delay agent, low temperature crosslinker activation, additive neutralization, slow acid dissolution, pH neutralization, $CO_2$ dissolution, low temperature delay agent dissolution, high temperature delay agent dissolution, oxygen entrapment in the fluid, polymer degradation, low temperature polymer crosslinking, low temperature shear induced decrosslinking, chemical oxygen scavenging, polymer stabilization, polymer hydrolysis, proppant coating by additives and resins, high temperature crosslinker dispersion, high temperature crosslinker dissolution, high temperature crosslinker complexing with delay agent, high temperature crosslinker activation, polymer adsorption onto proppant, crosslinker adsorption onto proppant, delay agent adsorption onto proppant, breaker adsorption onto proppant, resin adsorption onto proppant, resin coated proppant activation, resin coated proppant adhesion, shear induced polymer degradation, breaker dispersion, breaker dissolution, breaker diffusion, breaker activation, active breaker scavenging, breaker induced polymer degradation, encapsulated breaker burst release, enzyme dispersion, enzyme dissolution, enzyme deactivation, enzyme release, enzyme induced polymer degradation, and the like.

The combination of all these processes and others, some contributing to increasing fluid viscosity, and others contributing to decreasing viscosity at various rates as a function of time, temperature, and position in the process is responsible for the final performance of the treatment. Many of these processes are kinetically dependent on each other and on parameters such as chemical product concentrations, flow rates, residence time, mixing energy, flow pattern, fluid viscosity, fluid temperature, pressure, closure stress, and others.

With such level of interrelation and interaction, a mathematical model of the process may be used for full understanding of the chemical and physical processes, especially in order to make real time decisions related to the fluid performance during a treatment. Mathematical models can be used to provide a better understanding of the processes involved in well stimulation operations and in particular in fracturing. These can be time and space dependent mass balance equations, which can be written for each of the components (for instance for the Cj the concentration of chemical j at time t in the position x,y,z in space), or for parameters that describe the fluid such as rheological parameters such as the fluid shear viscosity at time t in the position x,y,z in space. A holistic approach to the problem may make use of the mass, heat and momentum transfer equations, to solve for parameters such as individual species concentration, fluid temperature, pressure, fluid velocity or rheological properties as a function of time and spatial coordinates. Suitable examples of such equations useful to the process can be found in the literature. Reference is made to Perry's Chemical Engineering Handbook $7^{th}$ Edition (Section 5, 5-1; 5-19, 5-42; 5-47, and Section 6, 6-1; 6-8), which is incorporated herein by reference.

A general mass balance for the system can be established as per the continuity equation. The differential form of the continuity equation (1) is:

$$\frac{\partial p}{\partial t} + \nabla \cdot (\rho u) = 0 \tag{1}$$

where ρ is fluid density, t is time, and u is the fluid velocity, which depends of time and position in space. If density ρ is a constant, does not change with time or spatial coordinate, as in the case of incompressible flow, (typically where no gas is involved) the mass continuity equation simplifies in this case to a volume continuity equation (2):

$$\nabla \cdot u = 0 \tag{2}$$

For each of the components j of the fluid, individual species concentration balances can be written as per equation (3), in order to estimate their respective concentrations Cj.

$$\frac{\delta Cj}{\delta t} = u\nabla Cj + Dj\nabla^2 Cj + Rj \tag{3}$$

where Dj is the diffusion coefficient for component j in the fluid, which is typically function of the fluid viscosity, and Rj is the reaction rate time, the rate at which chemical j appears at time t in position x,y,z, as a result of chemical reactions. When chemical j disappears through chemical reaction the sign of Rj is negative. While in the foregoing the space coordinates might be referred to as x,y,z, the choice of space coordinates that best suites the resolution of the mathematical equations and the symmetry of the geometry is not a limitation to the description or implementation of the invention disclosed. Equations correlating the diffusion coefficient Dj with viscosity can be established such as the well known Stokes-Einstein equation (4), which relates the diffusion coefficient of component j in the fluid to the fluid viscosity, the absolute temperature T, and the size dj of the component j in the fluid:

$$Dj = \frac{KT}{12\pi d_j \eta} \tag{4}$$

A heat balance for the system is another equation that may be used to appropriately describe the treatment. This is typically formulated to determine the temperature T of the fluid in space at time t by resolving the energy conservation equation (5):

$$\rho Cp\frac{\delta T}{\delta t} = \rho Cp\nabla uT + k\nabla^2 T + RQ + \Phi \tag{5}$$

As a function of the fluid specific heat Cp, the heat accumulated in the system can be calculated, and thus the temperature increase by accounting for the heat transferred by convection, the heat transferred by conduction, the heat generated by chemical reaction RQ, and the heat dissipated through viscous heating Φ. The heat generated by chemical reaction is the sum of the heat generated by each the chemical processes p which is calculated as the product of the enthalpy ΔHp of the process, and its reaction rate Rp.

The fluid velocity may be calculated by resolving the momentum conservation equations for each spatial coordinate x,y,z, as in equation (6):

$$\frac{\delta \rho u}{\delta t} + \nabla \rho uu = -\nabla P - \nabla \tau \tag{6}$$

This correlates the flux with the forces the fluid is subjected to, such as pressure P or mechanical stress τ, given that appropriate constitutive equations (fluid equations of state) are available. A constitutive equation is a tensorial relation that correlates the mechanical stress τ with the deformation rate D, which in turn is calculated from the fluid velocity through the equation (7) below:

$$D = \frac{1}{2}\{\nabla u + [\nabla u]^T\} \tag{7}$$

Suitable constitutive equations for the purpose of the invention can be viscous fluid, elastic fluid, or viscoelastic fluid constitutive equations. These fluid constitutive equations have the form (8) below:

$$\tau=\tau_s+\tau_p \tag{8}$$

For which the viscous contribution $\tau_s$, and the polymer elastic contribution $\tau_p$ of the total mechanical stress are separated. A generalized equation for viscous fluids can be generally used for most fluids as in (9) below:

$$\tau_s=2\eta_s(\dot{\gamma})D \tag{9}$$

This relates the viscous stress to the deformation rate by means of the fluid viscosity that in the generic case will depend on the shear rate $\dot{\gamma}$ that is defined as the second invariant of the deformation rate tensor (10):

$$\dot{\gamma}=\sqrt{\frac{1}{2}[D:D^T]} \tag{10}$$

A viscous model for Newtonian viscous fluids arises when the viscosity is independent of the shear rate. Other viscous models of interest are those such as the power law model (11):

$$\eta_s(\dot{\gamma})=K(\dot{\gamma})^{n-1} \tag{11}$$

or the Carreau Model (12):

$$\frac{\eta_s(\dot{\gamma})-\eta_s(\infty)}{\eta_s(0)-\eta_s(\infty)}=\{1+[\lambda(\dot{\gamma})]^2\}^{\frac{n-1}{2}} \tag{12}$$

or its generalized form, the Carreau Yasuda Model (13):

$$\frac{\eta_s(\dot{\gamma})-\eta_s(\infty)}{\eta_s(0)-\eta_s(\infty)}=\{1+[\lambda(\dot{\gamma})]^a\}^{\frac{n-1}{a}} \tag{13}$$

Viscoelastic models can also be used to jointly resolve the momentum balance for the liquid to determine pressure, viscosity, and velocity profiles during the treatment. Non-limiting examples of such models are those such as the linear viscoelastic models, or the non-linear viscoelastic models, among which the most common are the Maxwell model, Voigt-Kelvin model, Generalized Maxwell model, upper convected model, Giesekus model, FENE-P model, BNP model, Olroyd model, Olroyd-B model, K-BKZ model, PTT model, PPT-X model, etc.

Reaction rate equations can be established for each of the chemical reactions Rj or the different processes Rp.

Many examples of processes, and their respective rate equations to be considered for the formulation of such models are available in the polymer reaction engineering literature, in the chemical reaction engineering literature, and similar scientific areas of knowledge, and it is not the purpose of this disclosure to provide a comprehensive list of the kinetic equations and models that could be used or formulated for the purpose of each implementation of the content of this disclosure. The estimation of the effective dissolved concentration for the radical breaker (e.g. ammonium persulfate, APS) is used as an example. For this material balance, a few chemical reactions and processes may be considered in order to establish the material balance of APS in the fluid at time t in a fluid element x,y,z. An example of chemical and physical processes that control the concentration of APS in the process are described. Processes that cause an increase of dissolved APS concentration $C_{APS}$ and their respective process rates include:

- dissolution of APS from solid, $Rdis_{APS}$
- diffusion of APS from encapsulated breaker pellets, $RDiff_{ECAPS}$
- dissolution of APS from busted encapsulated pellets, $Rdis_{ECAPS}$ Examples of processes and their respective process rates that may be considered for modeling the decrease of dissolved APS concentration $C_{APS}$ include:

- precipitation of dissolved APS from solid (reverse reaction of the solubility equilibrium), $Rprec_{APS}$
- diffusion of dissolved APS into encapsulated breaker pellets, $RDiff_{APS}^{1}$
- thermal decomposition of dissolved APS, $Rtd_{APS}$
- pH catalysed thermal decomposition of dissolved APS, $RrdpH_{APS}$
- monosaccharide catalysed redox decomposition of dissolved APS, $Rrdmon_{APS}$
- polysaccharide catalysed redox decomposition of dissolved APS, $Rrdpol_{APS}$
- Iron(II) catalysed redox decomposition of dissolved APS, $RrdFe_{APS}$ An example of the rate equations controlling the appearance or disappearance of APS in solution is the following equation (14):

$$\begin{aligned}R_{APS}&=Rdis_{APS}+RDiff_{ECAPS}+Rdis_{ECAPS}+\\&-\{Rprec_{APS}+RDiff_{APS}^{-1}+Rtd_{APS}+RrdpH_{APS}++Rrdmon_{APS}+\\&\qquad Rrdpol_{APS}+Rrdpol_{APS}+RrdFe_{APS}\}\end{aligned} \tag{14}$$

Where the rate equations are function of rate constants and various species concentrations of equations (15) to (24) below:

$$Rdis_{APS}=kdis_{APS}C_{solidAPS} \tag{15}$$

$$RDiff_{ECAPS}=kDiff_{ECAPS}C_{ECAPS}N_{beads}P \tag{16}$$

$$Rdis_{ECAPS}=kdis_{ECAPS}C_{ECAPS}\{C_{beads}-C_{crit}\}\{P-P_{crit}\} \tag{17}$$

$$Rprec_{APS}=kdis^{-1}{}_{APS}C_{AAPS} \tag{18}$$

$$RDiff^{-1}f_{ECAPS}=kDiff^{-1}{}_{ECAPS}C_{APS}P \tag{19}$$

$$Rtd_{APS}=ktd_{APS}C_{APS} \tag{20}$$

$$RrdpH_{APA}=krdpH_{APS}C_{APS}10^{-pH} \tag{21}$$

$$Rrdmon_{APS}=krdmon_{APS}C_{APS}C_{mon} \tag{22}$$

$$Rrdpol_{APS}=krdpol_{APS}C_{APS}C_{pol} \tag{23}$$

$$RrdFe_{APS}=krdFe_{APS}C_{APS}C_{Fe} \tag{24}$$

Some of these processes are irreversible chemical reactions or processes, whereas others are reversible equilibria. For the equilibrium processes, forward and reverse reaction rate constants are related through the equilibrium constant (25):

$$kDiff_{ECAPS}^{-1}=\frac{kDiff_{ECAPS}}{KDiff_{ECAPS}} \tag{25}$$

In general all reaction rate constants are functions of temperature, following for instance an Arrhenius expression (26):

$$ktd_{APS} = ktd^0_{APS}\exp\left[\frac{-EAtd_{APS}}{RT}\right] \quad (26)$$

In some cases, in the interest of simplicity, rather than resolving the material balances for each component, dynamic balances for material properties MP of the fluid can be formulated where RMP is the rate of increase of the material property due to the various processes involved (27):

$$\frac{\delta MP}{\delta t} = -u\nabla MP + RMP \quad (27)$$

One example could be a dynamic balance for the rheological properties for the fluid such as viscosity η, or elastic modulus, G', or other fluid properties such as pH, as in (28) below:

$$\frac{\delta \eta}{\delta t} = -u\nabla \eta + R\eta \quad (28)$$

Where Rη, would be the net increase of viscosity due to the various processes involved such as polymer dissolution, hydration, polymer degradation, polymer crosslinking, and the like. In some instances the determination of other fluid parameters such as rheological properties like the fluid viscosity, elastic modulus, tan δ, loss modulus can be of interest. In this case, joint resolution of the mathematical equations for said properties with the concentration of a few chemicals may be required. A possible set of equations for the viscosity of a linear fluid $\eta(\dot{\gamma})$, at time t, in the position x,y,z, where the shear rate is $\dot{\gamma}$, the temperature T, the pressure P, and the polymer concentration is Cpol and the polymer molecular weight Mw, the fluid relaxation time λ, the solvent viscosity $\eta_{solvent}$, could be as follows.

The linear fluid viscosity depends on the polymer concentration and the intrinsic viscosity [η] represented through Martin's equation (29).

$$\eta_s(0)=\eta_{solvent}[1+C_{pol}[\eta]\exp(K_M C_{pol}[\eta]^b)] \quad (29)$$

For which the Mark-Howink-Sakurada equation allows one to calculate the intrinsic viscosity from the polymer molecular weight Mw, as in (30):

$$[\eta]=K_{MHS}Mw^{aMHS} \quad (30)$$

The fluid viscosity may be calculated as a function of shear rate through the Carreau-Yasuda model (31):

$$\frac{\eta_s(\dot{\gamma}) - \eta_s(\infty)}{\eta_s(0) - \eta_s(\infty)} = \{1 + [\lambda(\dot{\gamma})]^a\}^{\frac{n-1}{a}} \quad (31)$$

And both zero shear viscosity and infinite shear viscosity (often identified with the solvent viscosity) are functions of temperature through Eyring equations (32) and (33):

$$\eta_s(0) = K_\eta\exp\left[\frac{-EA_\eta}{RT}\right] \quad (32)$$

$$\eta(\infty) = K_\infty\exp\left[\frac{-EA_\infty}{RT}\right] \quad (33)$$

Other equations of interest could be written to describe the increase in elastic modulus $G'_0$ due to borate crosslinking, due to organometallic crosslinking, or due to both borate and organometallic crosslinking, by determining the crosslinking density for each type of crosslinking bonds $C_{BorateXL}$, $C_{ZrXL}$, as in equation (34):

$$G_0'=3[C_{BorateXL}+C_{ZrXL}]RT \quad (34)$$

Viscoelastic models including the viscosity and the elastic modulus calculated from mass balances through these or similar equations such as the Maxwell model, can be established. In addition, kinetic models for the crosslinking density can be formulated, or derived from literature studies, or determined through experiments or empirical correlations, other models for polymer molecular weight degradation, and thus viscosity reduction can also be derived from suitable literature references, or determined through suitable experiments. Other parameters of interest for the process, such as friction pressure, surface pressure, etc., can be modeled following a similar process. Models for other rheological parameters for multiphase fluids like foamed or emulsion fluid such as emulsion of foam viscosity can be easily estimated based on existing correlations models for the dispersed phase size distribution, the vapor liquid equilibrium VLE and gas phase equations, and or experimental measurements of the dispersed fluid viscosity. Models with a higher or a lower degree of complexity can be formulated. Difference between models can be established based on the required number of variables to be modeled, and the resulting number of parameters (constants) to be estimated. An optimum degree of description can be reached for each problem for which the mathematical description of the physical and chemical processes is sufficient for the fluid quality control problem in hand, and for which the number of experimental parameters to be determined is small. Too simplistic models, that do not describe the process in a sufficient level of detail might not be appropriate; similarly, complicated models that over describe the process might be formulated, for which the benefit is reduced. With the present disclosure, those skilled in the art will be able to formulate chemo-mathematical models that best suits the particular application (e.g. linear polymer fracturing fluid, crosslinked polymer fracturing fluid, foamed fracturing fluids, emulsion fracturing fluids, slick water fracturing fluids, bull heading acid formulations, sandstone acid treatments, acidizing treatments, organic clay acid treatments, gravel packing treatments, sand consolidation treatments, cementing treatments, well abandonment treatments, water control treatments, diversion treatments, and the like). Such models can be considered feed forward control models for the process if used to provide set points for design action variables of the process.

While certain variables are controllable, such as additive concentration, there are several parameters or variables that are not readily controllable. These uncontrollable variables may include solvent or mix-water, proppant temperature, mix-water quality or temperature, biocide concentration, clay stabilizer concentration, or degree of resin curing in the proppant. All these uncontrollable variables can be considered as "noise" that may affect the chemical reactions occurring during the formulation, pipe transit, fracture initiation, propagation, propping, closure, clean up, etc., and that may have an effect on the formed treatment fluid so that it differs from that which was initially designed, such as the designed target viscosity of the fracturing fluid. As such, this would significantly modify the expected results from the treatment. This feed-forward model in general consists of a series of equations that given a few inputs, as Xdes(t), and can be used to predict the value of a few selected parameters of interest Ydes(t). Inputs Xdes(t) for the model can be desired feed rates for additives or the treatment (set points), or actual feed rates for additives or the treatment as measured during a treatment, whereas the selected parameters of interest Ydes(t) could be any predicted variable of interest in the process, such as friction pressure in a pipe, linear fluid viscosity, degree of hydration, crosslinked fluid viscosity, complex viscosity, normal stress, shear stress, elastic modulus, onset of crosslinking temperature, etc.

In the present invention, to account for these uncontrollable variables, various fluid properties of the different streams may be monitored and used to make adjustments in one or more of the controllable variables. These adjustments may be made to conform as close as possible to the designed treatment, which may be based on treatment or fluid simulation models, as needed as the treatment fluid is being continuously prepared and pumped into the wellbore and into the formation.

Figure 2:
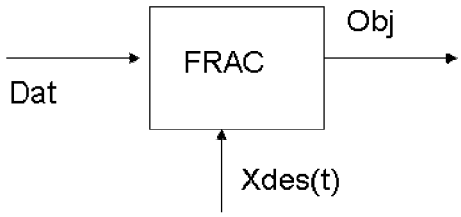
FIG. 2 is a diagram of a numerical execution of a hydraulic fracturing simulation operation FRAC given a set of formation parameters Dat, and a set of design values for the actionable variables of the process Xdes(t) that results in a series of fracture performance or objective variables Obj.

Further description will be concentrated with reference to fracturing processes, although similar methods could be used for any oilfield treatment of interest, as has been discussed. To provide a better understanding of the invention, reference is made to the diagram FIG. 2. As referenced in FIG. 2, let Obj be a vector of desired performance or objective variables expected to be achieved by the execution of the hydraulic fracturing or other treatment. Performance variables of interest may include parameters such as fracture length, fracture width, fracture height, fracture conductivity, expected production enhancement, skin factor, etc. Dat is a vector of formation parameters of interest for the design of the hydraulic fracturing. Parameters of interest may include those such as the formation rock's Young's Modulus, fracturing gradient, Poisson's ratio, minimum in-situ stress, well design, fracture toughness, number and type of perforations, pay zone height, pay zone depth, stress profile, rock porosity and permeability, reservoir pressure, rock compressibility, oil, gas and water saturation, rock heat capacity, rock thermal conductivity, etc. Finally, let Xdes(t) be a vector of designed values of actionable variables during the execution of a hydraulic fracturing treatment at a time t. As discussed, the actionable variables may include flow rates of fluid streams and concentrations of additives pumped or added to the fluid flow stream(s) during a hydraulic fracturing execution or other treatment, such as polymer, water, crosslinker, breaker, activator, delay agent, oxygen scavenger, proppant, resin coated proppant, etc.

A hydraulic fracturing treatment can be simulated with existing software packages given a set of formation parameters Dat, and a set of designed actionable variables Xdes(t). Let FRAC be a mathematical operator, which may be a series of numerical and algebraic mathematical transformations, such as those included in the geo-mechanical models used in simulating a hydraulic fracture. Such simulation computer software is commercially available and commonly used in designing fracturing treatments. An example of a suitable commercially available software product is that marketed as FracCADE® fracturing design and evaluation software, available from Schlumberger Technology Corp., Sugar Land, Tex. Other examples of simulation and modeling methods and devices include those described in U.S. Pat. Nos. 6,876,959 and 7,509,245, each of which is incorporated herein by reference. Using such software or similar software one is able to predict Obj when applied simultaneously to Dat and Xdes(t), according to the general equation, Obj=FRAC [Dat, Xdes(t)], as in FIG. 2.

Figure 3:
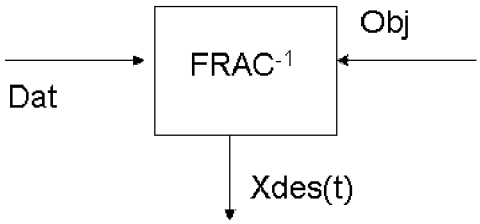
FIG. 3 is a diagram showing the designed value of the set of actionable variables of the process Xdes(t) can be defined given a set of formation parameters Dat, and a set performance or objective variables Obj by inverting the numerical execution of a hydraulic fracturing simulation operation $FRAC^{-1}$.

Through such known methods, a fracturing design engineer can decide upon the best choice of design values of the actionable variables of the process Xdes(t) given a known formation parameters Dat. Such methods may include iterative methods, optimization methods, search methods, comparison methods, montecarlo methods, simplex methods, complex methods, mardquart methods, linear and non linear regression methods, least square methods, experimental design methods, and the like. These methods may be used to obtain a set of desired fracture performance or objective variables Obj. In general, the job of a fracturing design engineer can be thus described as the inversion of the fracturing simulation problem, and be represented by an inverse operator $FRAC^{-1}$, as illustrated in FIG. 3. The inverse operator $FRAC^{-1}$ facilitates defining the value to be assigned the actionable variables Xdes(t) required to design a fracture fulfilling the set of objective variables Obj given a set of formation parameters Dat according to $Xdes(t)=FRAC^{-1}$ [Obj, Dat], as in FIG. 3.

In accordance with the invention, the design values of the actionable variables of the process Xdes(t) may be further refined by employing feedback from monitored fluid properties of various fluid streams. Non-limiting examples of monitored fluid properties may include pH, temperature, shear viscosity, complex or dynamic viscosity, chemical or additive concentration, viscosity profile, break profile, degree of crosslinking, additive molecular weight, onset temperature for crosslinking, elastic modulus, loss modulus, tan δ, fluid thermal thinning, proppant settling velocity, pressure, friction pressure, maximum treatment rate, maximum treating pressure, and the like. In certain embodiments the fluid property for which the model provides the feedback is monitored substantially continuously and may be in real time. The monitored variable fluid properties of interest may be monitored periodically or substantially continuously, however. With respect to the monitoring that occurs "substantially continuously," this is meant to encompass the monitoring of fluid properties that is generally ongoing, in real time or with a slight delay, and that may be measured at short intervals of time of generally less than about 2 minutes to about 10 seconds or less between each measurement, or the measurements are provided generally constantly. As used herein, the expression "periodically," "sparsely" or similar expressions used with respect to the monitoring is meant to encompass the frequency of monitoring that is conducted where there is a significant amount of time that elapses between each monitoring event. In certain embodiments, the period of time between each periodic monitoring event may be from about 1 minute or 2 minutes to about 20 minutes, or from about 10 minutes to about 2 hours or more depending on the variable measured and the process of interest.

The monitoring of fluid properties may be conducted on-line or off-line. As used herein, the expression "on-line" with respect to measuring or monitoring of the various fluid properties is meant to encompass monitoring that is conducted at the fluid streams or fluid sources utilizing measuring or monitoring equipment that is coupled to or that engages the fluid streams or sources without the necessity of removal of a fluid sample to a remotely located monitoring station. In this case, typically an electronic signal (digital or analogic) proportional to the measured value is sent and stored continuously on a PLC, a hard drive, a server a command post, a control room, a control computer, or the like. As used herein, the expression "off-line" with respect to measuring or monitoring of the fluid properties is meant to encompass monitoring wherein a fluid sample is removed from the fluid stream or fluid source to a remote monitoring station where the properties are then monitored or measured. In this case typically a periodic interface (with or without human intervention) but most likely requiring a human interface is needed to introduce an electronic signal (digital or analogic) proportional to the measured value which is in turn transmitted and stored on a PLC, a hard drive, a server, a command post, a control room, a control computer, or the like.

Figure 4:
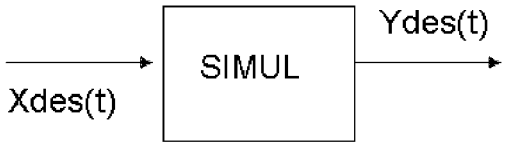
FIG. 4 is a diagram showing a set of actionable variables of a process Xdes(t) being fed to a new simulator SIMUL, where fluid parameters of interest Ydes(t) are calculated.

Referring to FIG. 4, a numerical method designated SIMUL, which may employ theoretical or empirical equations, such as those previously described, may be used to predict intermediate variables of interest in the process Ydes (t) at a particular point of interest at time t and space x,y,z, in the process. Variables of interest in the process are parameters that can be measured, calculated or estimated in the process such as temperature, viscosity, polymer concentration, breaker concentration, sand concentration, active crosslinker concentration, number and/or concentration of crosslinking points, polymer molecular weight, onset temperature for crosslinking, elastic modulus, sand settling velocity, pressure, etc. Points of interest in the process, x,y,z, may be specific steps in the process, such as a point of injection of a certain stream, the inlet, the outlet or any other particular point of an item of equipment, such as a pump, a tank, a blender, a pipe, a valve, a chamber, a point of mixing of multiple streams, the well head, a certain depth in the wellbore, a perforated zone of the wellbore, a certain x-y-z position in the fracture, or in the reservoir. A point of interest x,y,z, as described herein can be considered a very small region, but might also be considered a length of tubing, or a piece of equipment, when the variable of interest Ydes(t) is a difference between smaller regions (e.g. a differential pressure per unit length, or a temperature difference between two points).

In the diagram of FIG. 4, Ydes(t) designates a vector of updated designed (and desired) values for a particular variable of interest in the process calculated, at a particular point of interest in the process x,y,z, at time t using the feedback from continuously monitored fluid streams. This set of values Ydes(t) can be obtained by using a simulation model that utilizes the designed values of a set of actionable variables Xdes(t), which may be those described for FIG. 3. The simulation method may be based on known principles, and on known polymer solution thermodynamics, polymer reaction engineering, basic chemical engineering principles, mass balances, temperature balances, momentum balances, heat transfer equations, conduction and convection equations, polymer rheology, and polymer reaction engineering correlations, and methods. The model may be used as a feedback model that utilizes measured variables that are monitored upstream or downstream to evaluate the required Ydes(t) at an actual or past time. Alternatively, or in addition, the model may be used as a feed-forward model that utilizes measured variable fluid properties to calculate upstream or downstream properties at a past, present or future time.

In one aspect of the invention, off-line monitoring may be used for some of the variables of interest in the process, such as Ydes(t). These may be compared to on-line measurements or may be used separately. The off-line monitored variable fluid property may include such properties as viscosity, pH, elastic modulus, crosslinking temperature, fluid thermal thinning may be provided. Such measurements may be conducted periodically off-line and used to provide updated design variables. In the past, monitoring of viscosity or the fluid's ability to transport proppant was typically carried out by visual inspection. Current viscometers, such as the Brookfield TT-100, AST-100, STT-100, TT-200 shear rheometers, have been used to provide a good estimation of the viscosity of linear fluids (polymeric solutions in water, with no particulates) in line, but these viscometers can become easily eroded when particulate fluids are pumped at a high rate.

Properties that may be measured off-line may include those determined using dynamic rheology tests. Dynamic rheometers have been available to polymer solution scientist for a number of years. Until recently, all the equipment available in the market capable of measuring dynamic rheology were "laboratory research equipment," able to measure reasonably low stress values for semisolid samples (thermoplastics), and for fluids at temperatures below boiling point at roughly atmospheric pressures, but too delicate to be moved from one field location to another. On the other hand, rheometers able to measure fluids at high pressure, and thus able to prevent significant fluid evaporation, were able to measure only rotational steady shear rheometry. Recently new rheometers capable of combining the high enough pressures required to prevent significant fluid evaporation of water at temperatures up to 450° F. (232.2° C.) with reliable dynamic measurements have been introduced to the market, which will be referred to as "robust dynamic rheometers." An example of one such commercially available rheometer is that available as the GRACE Instrument M5600 HPHT rheometer, which is rated up to 1000 psi and 500° F. The rheometer may be a true Couette, coaxial cylinder and rotational rheometer and may be employed with a viscoelastic module that can perform oscillatory tests for measuring elastic modulus, G', loss modulus G", complex modulus G*, complex viscosity $\eta^*$ and phase angle $\delta$, loss tangent tan $\delta$ as a function of frequency $\omega$. The use of such robust rheometers allows several parameters of interest to be determined that could not be determined previously. Using such dynamic rheometers, decisions regarding actionable variables may be made that previously could not be made.

Figure 5:
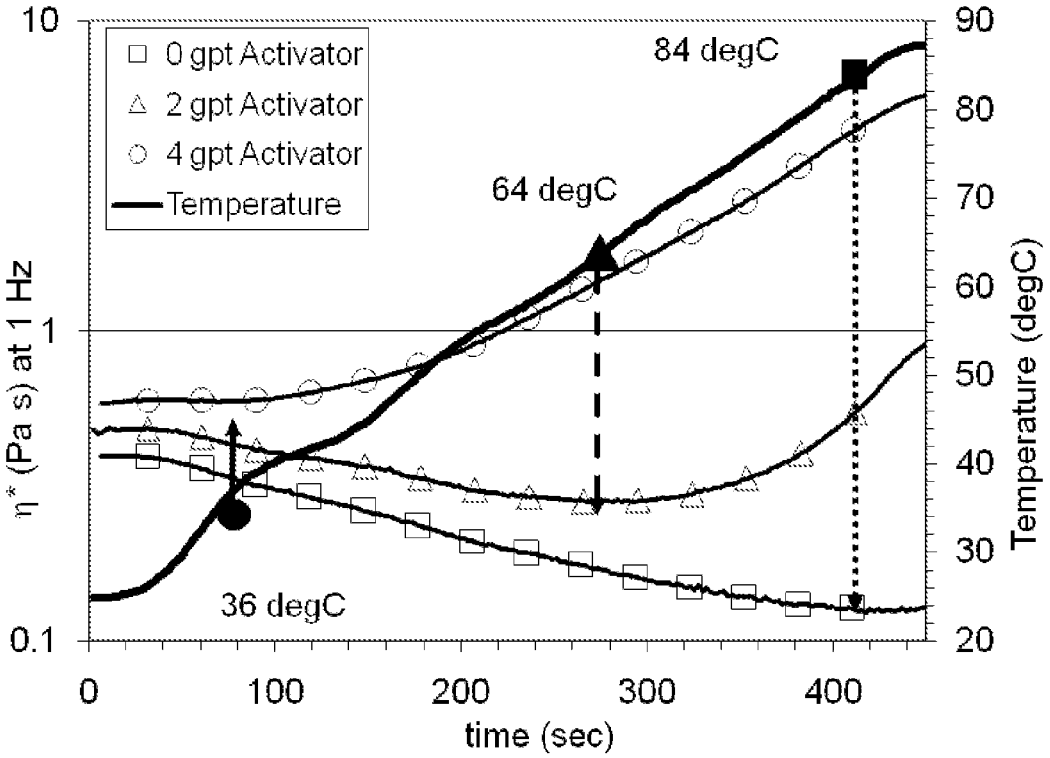
FIG. 5 is a plot showing the complex viscosity measured at 1 Hz for a series of polymer fluids containing varying amounts of crosslinking activator as a function of time for a given heating ramp.

FIG. 5 shows a comparison example between a few of the parameters of interest for a fluid with dual crosslinking (borate and Zr) for three fluids with various concentrations of the crosslinking activator, which is used with a dual borate (low temperature) and Zr (high temperature) crosslinker. In the graph, a dynamic rheology plot is obtained with a dynamic lab rheometer (a Bohlin Gemini stress rheometer). The extent of borate crosslinking can be determined based on the starting level for the complex viscosity $\eta^*$ at 25° C. The extent of thermal thinning $d\eta/dt$ of the borate crosslinked fluid can be estimated from this measurement. It can be also recognized that the onset of Zr crosslinking can be determined form this plot. In FIG. 5, the complex viscosity is depicted. For the curve at 4 gpt activator, the initial viscosity (at time zero) is higher than at 2 gpt activator and 0 gpt activator. FIG. 5 also shows the rate of thermal thinning $d\eta/dt$, which is also determined from the experimental measurements carried out with the dynamic lab rheometer, and is another variable of interest in fracturing treatments. In addition, FIG. 5 shows that the rate of thermal thinning is lowest at 4 gpt activator concentration and highest at 0 gpt activator. Moreover, FIG. 5 shows that the onset temperature of crosslinking XLT is highest at 0 gpt activator and lowest at 4 gpt activator. This can be of great importance in delayed crosslinked fracturing fluids and can be determined from the experimental measurements carried out with the dynamic lab rheometer. Other parameters such as G', G" and tan $\delta$, can be obtained and other fluid related predictions can be established, for instance sand settling, using dynamic rheometers. Similar results may be obtained in lab conditions using robust dynamic rheometers. An advantage of robust rheometers is that when required they can be used to measure rheological properties under pressure well above the atmospheric boiling point of the solvent.

Figure 6:
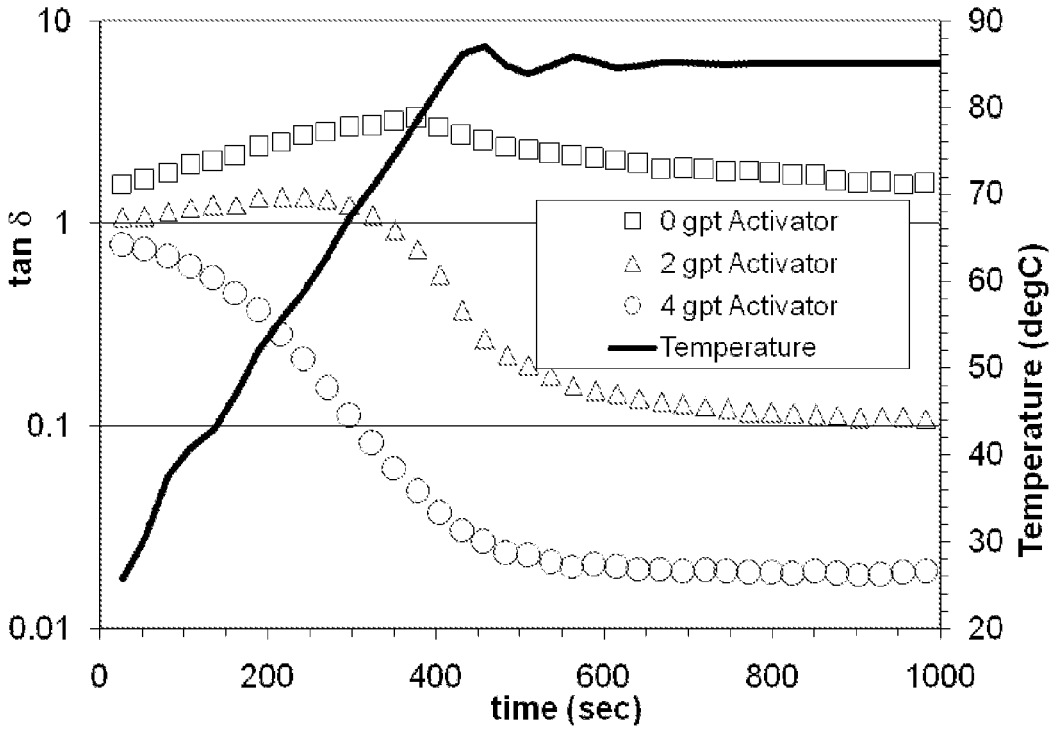
FIG. 6 is a plot of the loss tangent (tan δ) measured at 1 Hz for a series of polymer fluids containing varying amounts of crosslinking activator as a function of time for a given heat ramp and after an isothermal temperature is reached.
Figure 7:
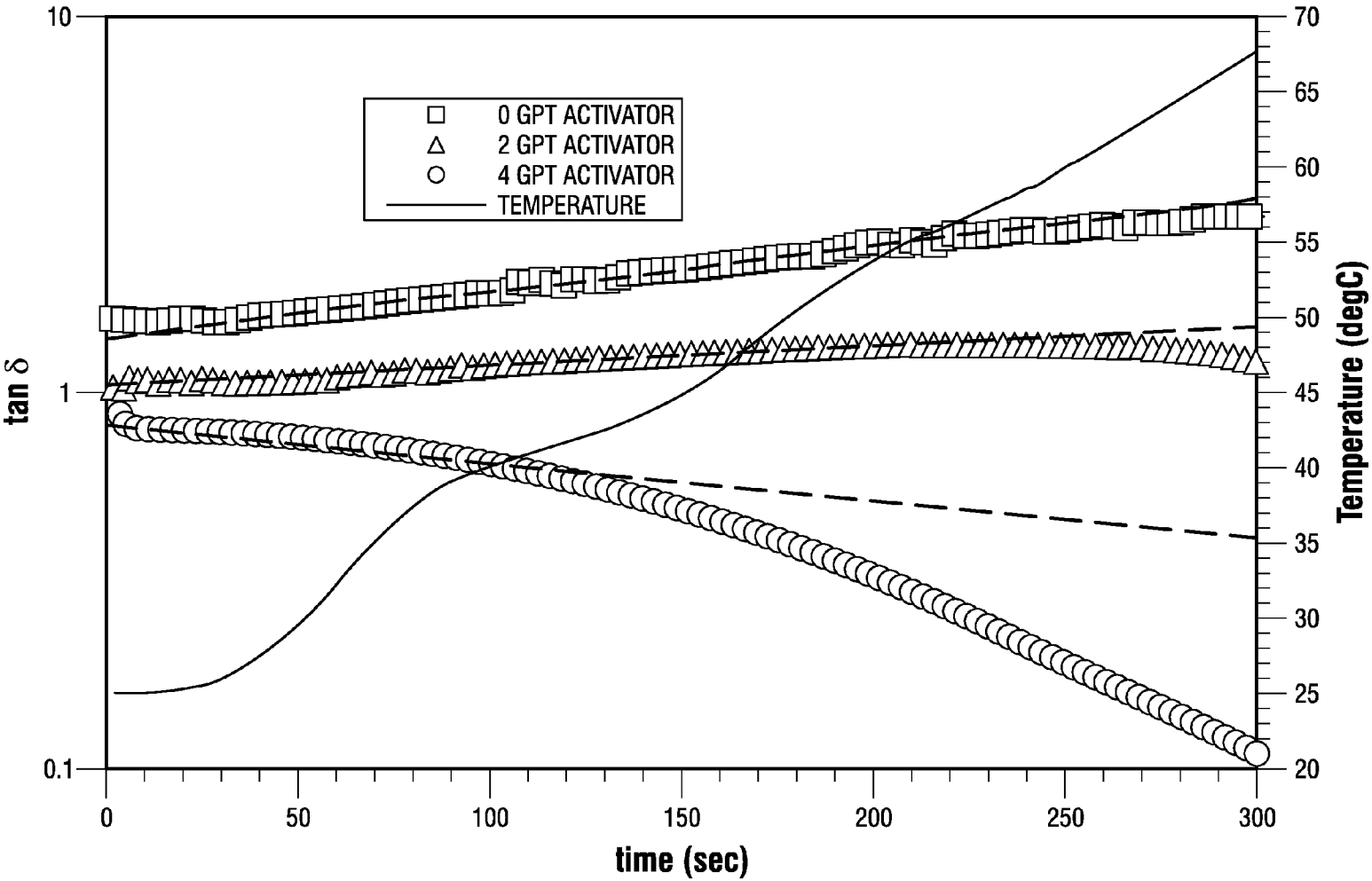
FIG. 7 is a detailed plot of the loss tangent (tan δ) measured at 1 Hz for a series of polymer fluids containing varying amounts of crosslinking activator where the slope at short times for a given heat ramp is also shown.

In addition, other kinetic parameters such as the rate of crosslinking at a given isothermal temperature can be obtained from studies in which the fluid is crosslinked at a certain heating ramp, and is kept isothermal thereafter, as depicted in FIG. 6. These measurements can be typically performed on samples obtained from the process. The advantage of this method compared with the existing ones (using Fann 35 and Fann 50 rheometers and microwave tests for crosslinking temperature) is that it provides more accurate measurements, since the determination of the viscosity is executed by varying the frequency, at small deformations, not at infinite deformation as in a typical steady shear Couette test. In addition, performing these measurements at lower deformations can better enable the measurement of rheological parameters without risk to the equipment in the presence of proppant. As shown in FIGS. 5 and 6, parameters such as initial viscosity or thermal thinning can be easily measured with the method described at very short times. Additionally, measurements such as the loss tangent, tan δ, allow for a simple determination of the onset for crosslinking by estimation from the maximum of the tan δ versus time and temperature curves. In addition, as shown in FIG. 7, the early time slope of the tan δ curve can be used to compare it to a desired performance profile that could be used as means of a control set point. The determination of the early time slope can be performed in very short tests, such as under three minutes, that enables this as a possible test for periodical measurements on-line. The information obtained from the experiments described herein has not been available to those currently controlling and performing field operations. In field operations, qualitative measurements such as the visual inspection after microwave test, have been commonly used. In the interest of increasing the sampling rate of an on-line measurement, even faster results may be obtained if the rate of temperature increase, set to 1° C. every 7.5 seconds in the experiments depicted (0.133° C./s) is increased to 1° C. every 5 seconds (0.2° C./s) or faster. Additionally an empirical equation that correlates the crosslinking temperature at a given fast heating rate with that considered optimum from lab measurements can be established.

In another aspect of the invention, the dynamic measurements may be executed on samples obtained automatically from the process, and measured on-line. An automatic sampling port may be used to pass the fluid to the dynamic rheometer, such as those described previously. For the purpose of this disclosure, the method of sampling, the geometry of the sampling and measuring port, and the process required for such sampling, or the number of serial or parallel sampling units required for any realization of the disclosure, is to be understood as non-limiting, although optimum designs for minimizing erosion, minimizing sampling and analysis time, and ensuring robustness and maximizing data sampling frequency may be selected.

Figure 8:
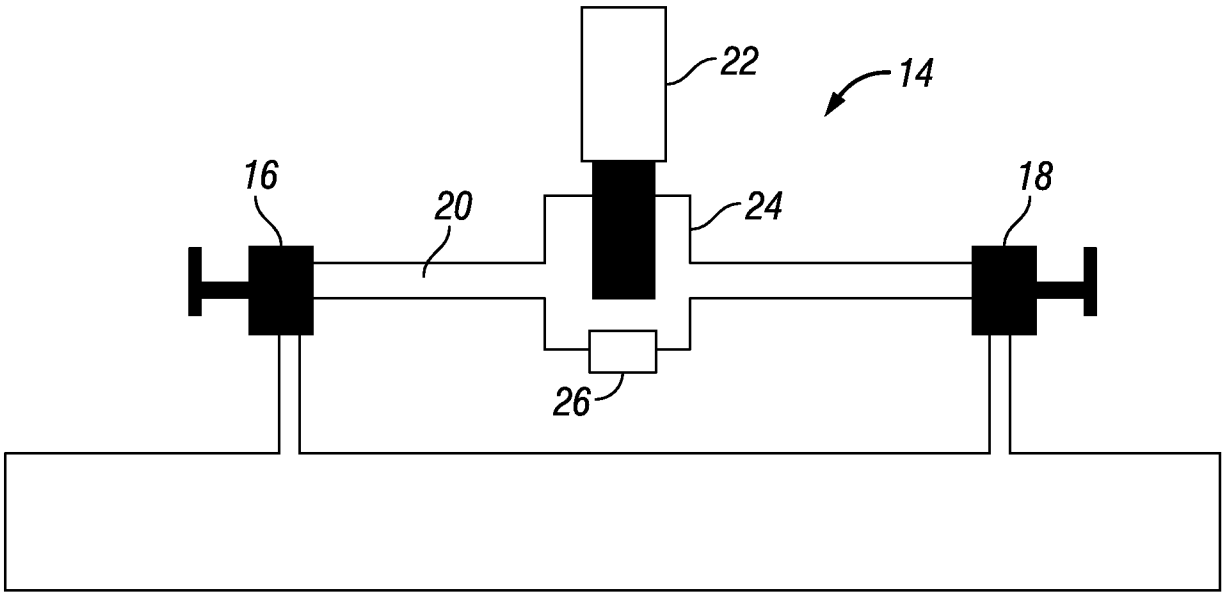
FIG. 8 is a schematic representation of a sampling flow loop device that may be installed on a line to gather and measure on-line fluid samples.

An example of such a sampling port 14 and process is illustrated in FIG. 8. The process of sampling is conducted in a series of steps. When isolating valves 16 and 18 of the sampling port 14 are closed, a fluid sample is trapped in the sampling loop 20 and the rheometer 22, and subsequently its rheology can be measured. At a desired point in time, valves 16 and 18 are opened, and the fluid is allowed to flow through the sampling loop 20 and measuring chamber 24. Additional measurements, such as pH, UV, IR, NIR, Raman, and the like, could be performed simultaneously to determine the parameters of interest for the fluid, at one or various measuring points 26. At an appropriate time, both valves 16, 18 are closed, and the rheological measurement of interest is performed at the temperature, time and frequency of interest. The sampling port 14 may be controlled remotely and can be remotely monitored bi-directionally (send and receive data). The monitored variable fluid properties using the on-line dynamic rheology monitoring device, such as the device 14, may be used in providing the updated designed (and desired) values for a particular variable of interest in the process, such as Ydes(t) as described before.

Figure 9:
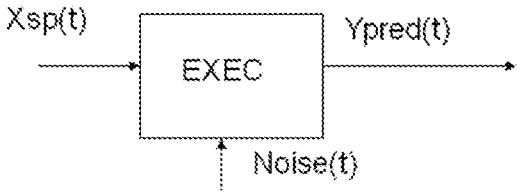
FIG. 9 is a diagram showing a set of actionable variables Xsp(t) being fed to a simulator EXEC where fluid parameters of interest Ypred(t) are predicted based on the evaluation of the impact of the actionable variables and a series of experimental disturbances Noise(t)

In another aspect of the invention, a method to further improve the prediction of a fluid parameter of interest of a fracturing fluid at surface and downhole is provided by comparing a model with a set of sparse or periodic measurements. Suitable sparse measurements could be pH, temperature, chemical compositional measurements rheological measurements, such as those described above. Reference is made to FIG. 9 where Ypred(t) is the output of a chemo-mathematical model EXEC, obtained matching in real time the execution of the treatment in real life conditions. For this real life simulation, parameters of interest Xsp(t) are the set points of the actionable variables of the process, as being currently pumped during the treatment. In addition multiple sources of disturbance to the process (noise) can be incorporated. Some of these sources of noise will be intrinsic to the performance of the pumping, and could be small departures from the set point of each of the fluid streams. Others will be substantial failures of equipment, during the treatment or changes of equipment to stand by back up equipment. Others will be related to the environment (temperature, water quality, pressure, well condition) that may be discovered during the pre treatment analysis, or uncovered during the treatment itself, or even non-perceived but existing and affecting the operation. Finally, others could be related to the quality of the raw materials used. Incorporation of noise to the calculation allows for a better evaluation of the instantaneous evolution of the process. It also allows for a better recognition, and, if possible, elimination of undesirable noise sources affecting the overall deliverance of the treatment. This may also make it possible to ascertain various trends during the treatment. Such trends could be mistakenly interpreted if the chemical contribution of the process is not properly incorporated. Various levels of signal filtering to eliminate white noise can also be included in the execution of the model EXEC when required or appropriate.

Figure 10:
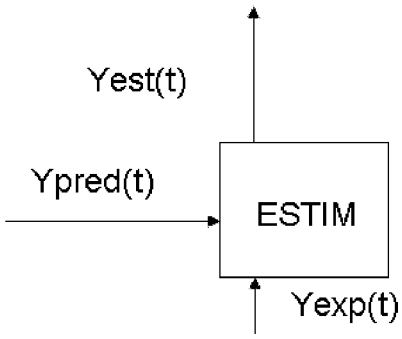
FIG. 10 is a diagram showing the estimated value of a set of fluid parameters of interest Yest(t) is obtained by comparison of the values predicted by a simulation Ypred(t) with a series of experimental measurements Yexp(t)

Referring to FIG. 10, Yest(t) is designated as a vector of estimated values of one or more variables of interest in the process, at a particular point of interest x,y,z in the process at time t by a model. Further, Ypred(t) is designated as a vector of predicted values of each of the variables of interest in the process, at a particular point of interest in the process at time t. Now let Yexp(t) be a vector of measured values of each of the variables of interest in the process, at a particular point of interest in the process at time t. These may be any of the monitored properties of the fluid streams using any of the monitoring processes previously described (e.g. on-line, off-line, continuous, periodic, etc.). In many cases, the monitored property is monitored or measured periodically. As shown, Ypred(t) may be the output of a process simulation or model, such as those previously described. Parameters of interest Ypred(t) can be pH, onset of crosslinking, crosslinking temperature, and others. An estimation algorithm ESTIM, which can be a simple regression, a Kalman Filter, or any other common numerical method that can be used to determine the estimation for the fluid parameters of interest Yest(t), can be used to refine the prediction of a simulation model Ypred(t) based on a experimental measurements Yexp(t), which may be a series of experimental measurements, as shown in FIG. 9. Estimated parameters of interest can be pH, onset of crosslinking, crosslinking temperature, viscosity, friction pressure, or expected treatment pressure.

The estimation can be done by forecasting values of the parameters of interest Ypred(t) at positions in the process x,y,z, and at times present, past or future during the treatment. As used herein the term "present" during the execution of a treatment refers to a snap shot of the performed simulations, and calculations that represents a time interval that corresponds with the actual time in the real life treatment being delivered. The term "past" during the execution of a treatment refers to a snap shot of the performed simulations, and calculations that represents a time interval prior to the actual time in the real life treatment being delivered. The term "future" during the execution of a treatment refers to an snap shot of the performed simulations, and calculations that represents a time interval subsequent to the actual time in the real life treatment being delivered. Evaluating events and estimating parameters in the past during the treatment allows for understanding the implications of actions in the past, and can provide better predictions and forecast for the events still to happen during the treatment (in the "future"), and in many occasions allows for advancing changes in response to these past events. Forecasting the expected treatment pressure at a future time due to changes in chemical composition, prior to the treatment reaching the formation can be of interest, as it might allow for modifications of the treatment. In addition the algorithm ESTIM allows for the determination of the extent or trends in noise, and enables one to extract fluid performance trends that could be hidden due to the noise.

As an example, the model ESTIM could be used to forecast the effect of a combination of flow streams departing from the target set point because of an unforeseen mechanical failure. Such an event may result in an undesired viscosity decrease that when reaching the formation could cause a screen out near wellbore. A chemo-mathematical model used in accordance with the invention can estimate the viscosity at the perforations well ahead of the fluid reaching the target. Thus, an alert can be provided to increase the catalyst rate and increase the pump rate, which would not result in an increase of the friction pressure, since the viscosity of the fluid in the pipe will be lower than the expected one. Situations such as these can arise when treating deep water wells where the time to perforations can be long (more than 10 minutes, and often up to 30 minutes).

Figure 11:
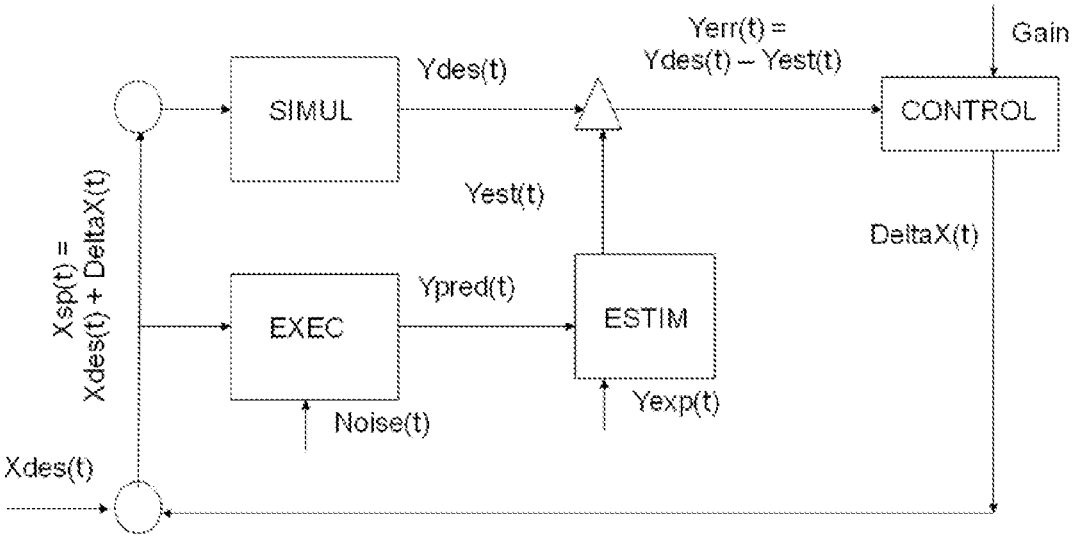
FIG. 11 is a process control diagram of a continuous process wherein a target for a series of actionable variable of the process at a time t where Xdes(t) may be modified by an incremental value DeltaX(t) to yield a new set point Xsp(t) that is used in the process control using a chemo-mathematical model, in accordance with the invention.

In another aspect of the invention, a method of controlling or adjusting a fluid parameter of interest of a fluid stream of a treatment fluid, such as a hydraulic fracturing fluid, at surface and downhole is provided based on the comparison between an estimation of the values of a series of parameters of the process Yest(t), with the design values Ydes(t), as shown in the diagram of FIG. 11. As shown in FIG. 11, Yerr(t) is a vector of differences between the desired values and the estimated values of each of the variables of interest in the process, at a particular point of interest in the process at time t Yerr(t) =Ydes(t)−Yest(t). DeltaX(t) is a vector of change to actionable variables of the process at a time t. Xsp(t) is a vector of set point values of actionable variables of the process at a time t, such that Xsp(t)=Xdes(t)+DeltaX(t). Uncontrollable factors or parameters of the process are indicated as Noise(t). Noise(t) can cause the designed value of selected process parameters Ydes(t) to differ from the actual measurements Yexp(t) and should be taken into account to allow for a better estimation of values during the execution Yest(t).

An on-line control algorithm designated CONTROL is used to improve the efficient delivery of a treatment fluid in the presence of such Noise(t). The control algorithm is based on the generation of a control action DeltaX(t) as a response to the difference Yerr(t), determined by an a choice of parameters GAIN, required for the selected algorithm which can be a typical control algorithm such as a Proportional (P), a Proportional Integral (PI), a Proportional Integral Derivative (PID), a Neural network, or other control algorithms commonly used in process control. The control algorithm amends the target for a series of actionable variables of the process at a time t Xdes(t), by an incremental value DeltaX(t) to yield a new set point Xsp(t).

As a means to further illustrate the invention the following examples are provided. The examples provided are hypothetical and are not necessarily based upon actual data or treatments performed and do not necessarily illustrate preferred modes of operation during a stimulation treatment. The examples are believed to be realistic, however, and provide insight to the application and the benefits that the invention can provide in certain cases.

EXAMPLES

Example 1

Figure 12:
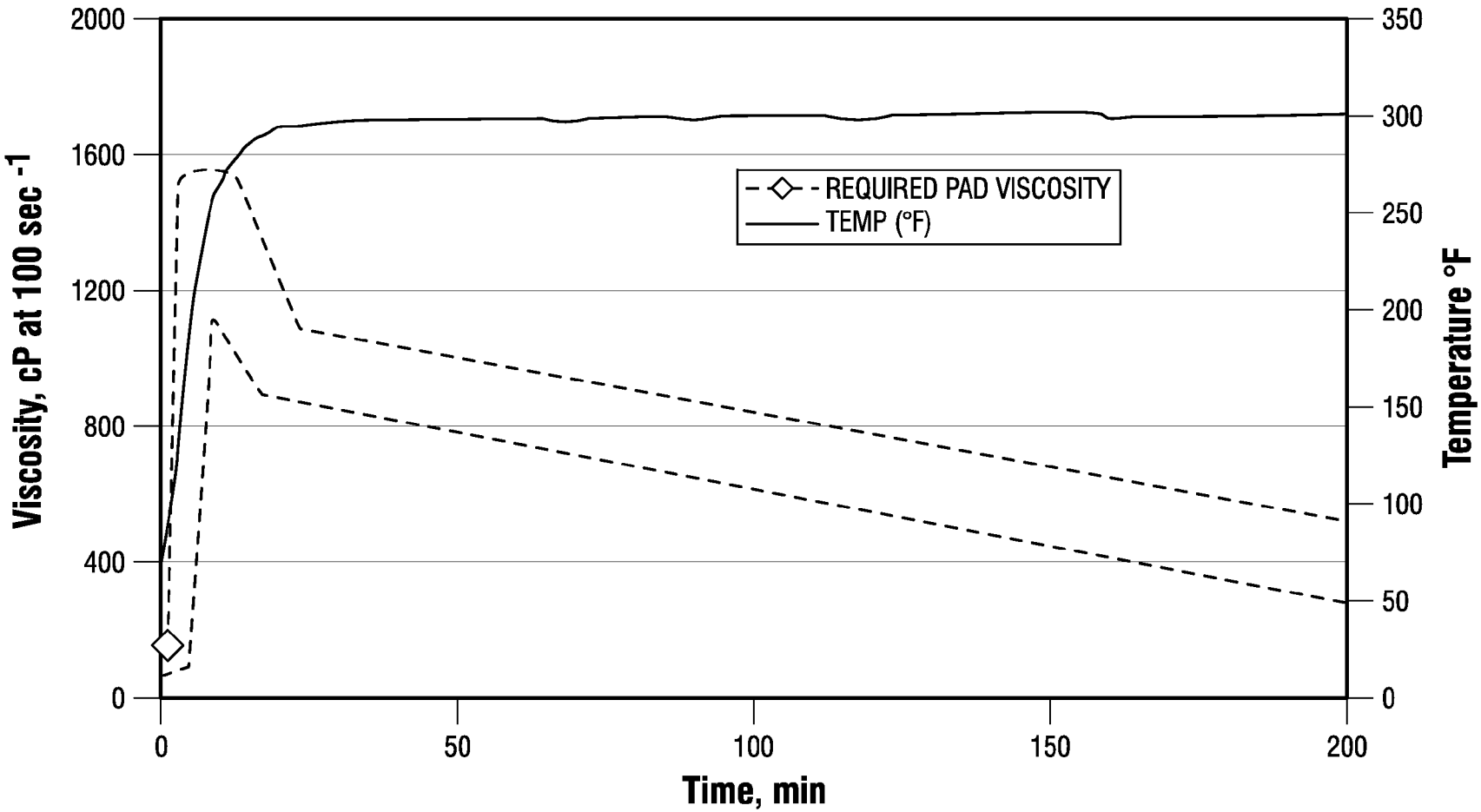
FIG. 12 is a detailed plot of required fluid viscosity for the PAD stage of a fracturing treatment according to EXAMPLE 1.

Based on data collected from logs, and the reservoir production expectations for the field it is located on, a well A is considered a candidate for stimulation by means of hydraulic fracturing, in a zone Zone Z. An effective fracture length and an overall geometry for the fracture is predetermined. The suggested fracture geometry is obtained by performing simulations with a fracturing model FRAC such as the one described in FIG. 2, to obtain the optimum fracture design given the production expectations, and well capability. A minimum required fluid rheology as a function of time, a suggested pumping schedule, and mass balance and a suggested flow back schedule with forced closure are proposed for the treatment. FIG. 12 depicts the range of required rheology profile for the treatment Pad stage, including upper and lower control margins. Table 1 provides the pumping schedule for the different stages and a coarse mass balance. Expected retained permeability for the fracture upon closure of the fracture is estimated given the required effective fracture length, and therefore the required rheology break profiles are determined based on known correlations residing in the modeling package FRAC.

TABLE 1

| Stage | time (min) | slurry rate (bpm) | prop conc (ppa) |
|---|---|---|---|
| PAD1 | 0 | 50 | 0 |
| PAD2 | 30 | 50 | 0 |
| PAD3 | 60 | 50 | 0 |
| PROP1 | 90 | 50 | 1 |
| PROP2 | 120 | 50 | 2 |
| PROP3 | 150 | 50 | 4 |
| PROP4 | 180 | 50 | 6 |
| FLUSH | 200 | 5 | 0 |

For this example it can be considered that fracture dimensions, effective frac length, production expectation, rheology profile, rheology break profile, pump rate, overall mass balance, and cost of the treatment are objective functions for the treatment.

Example 2

The inversion of the problem as per FIG. 3 is carried out. This determines a coarse fluid formulation and yields a series of design variables Xdes(t) for the treatment, given a known formulating rules and a fluid formulating manual. In addition a tentative breaker pump schedule is proposed.

Example 3

For the fracturing treatment designed for well A, a total of 5 frac tanks (T1, T2, T3, T4, T5) containing the water required for the treatment are provided from a city water source. Samples of all those frac tanks are taken and transported to a district lab the day before the expected treatment, where water analysis is performed, yielding the results in Table 2.

TABLE 2

| | T1 | T2 | T3 | T4 | T5 | average T1-T5 |
|---|---|---|---|---|---|---|
| $HCO_3^-$ (ppm) | 225 | 302 | 162 | 290 | 306 | 257 |
| $Ca^{2+}$ (ppm) | 62 | 73 | 51 | 103 | 120 | 81.8 |
| $Fe^{3+}$ (ppm) | 5 | 15 | 2 | 15 | 17 | 10.8 |
| Si (ppm) | 26 | 103 | 18 | 14 | 22 | 36.6 |
| T (deg F.) | 83 | 120 | 81 | 83 | 82 | 89.8 |

Figure 13:
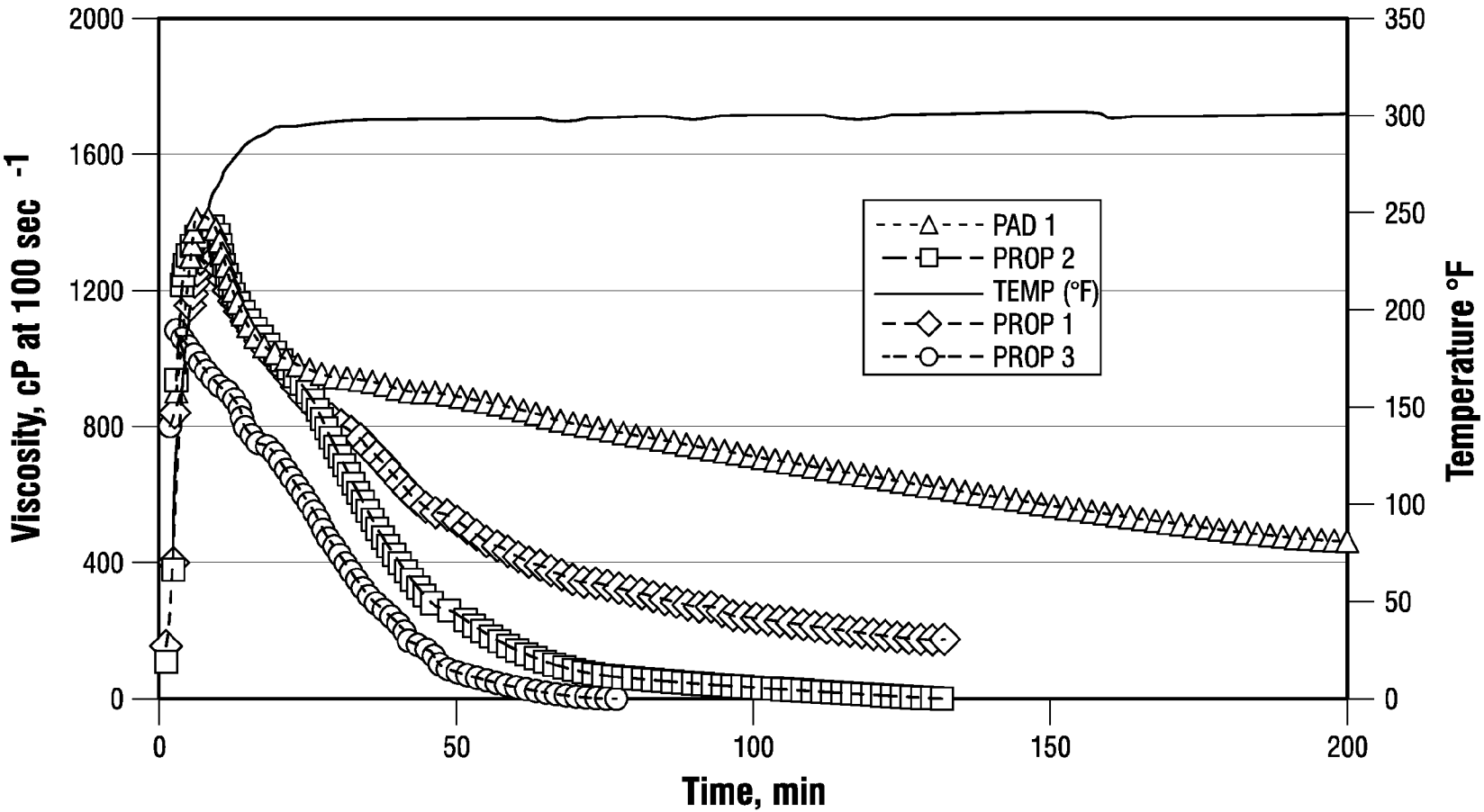
FIG. 13 is a detailed plot of the measured fluid viscosity for the PAD and PROP stages of a fracturing treatment according to EXAMPLE 3.
Figure 14:
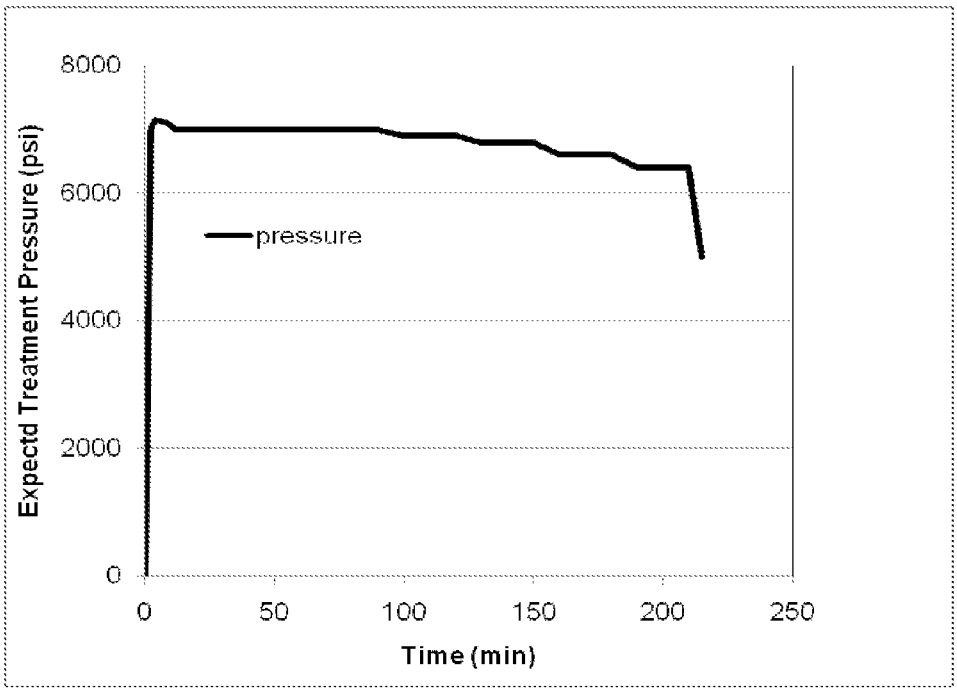
FIG. 14 is a detailed plot of the expected treatment pressure for a hydraulic fracturing treatment according to EXAMPLE 3.

Based on the analysis of the water tanks and the water temperature measured on location, the district lab reevaluates the preliminary fluid formulation and provides the rheology test results in FIG. 13. The results are created using one single source of water prepared by mixing equal amounts of all sampled frac tanks, with the average composition provided in Table 2. The concentrations of the chemicals used for the rheology test results, required for the fluid formulation are listed in Table 3. In addition a predicted fracturing pressure at surface is provided as per FIG. 14.

TABLE 3

| Stage | polymer (ppt) | Xlinker (gpt) | activator (gpt) | XLT_SP (deg C.) | pH_SP |
|---|---|---|---|---|---|
| PAD1 | 50 | 2 | 2.5 | 65 | 10.2 |
| PAD2 | 50 | 2 | 2.5 | 65 | 10.2 |
| PAD3 | 50 | 2 | 2.5 | 65 | 10.2 |
| PROP1 | 50 | 2 | 2.5 | 65 | 10.2 |
| PROP2 | 50 | 2 | 2.5 | 65 | 10.2 |
| PROP3 | 50 | 1.8 | 4 | 65 | 10.2 |
| PROP4 | 45 | 1.6 | 6 | 65 | 10.2 |
| FLUSH | 10 | 0 | 0 | 65 | 10.2 |

Figure 15:
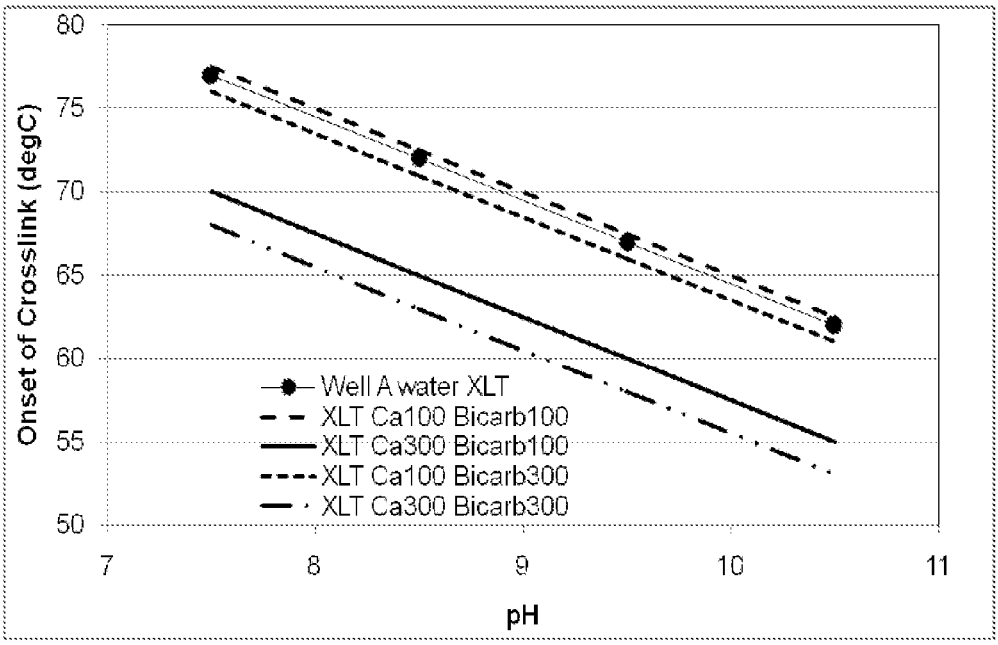
FIG. 15 is a sensitivity plot for the onset of crosslinking temperature as a function of the mix water composition according to EXAMPLE 3.
Figure 16:
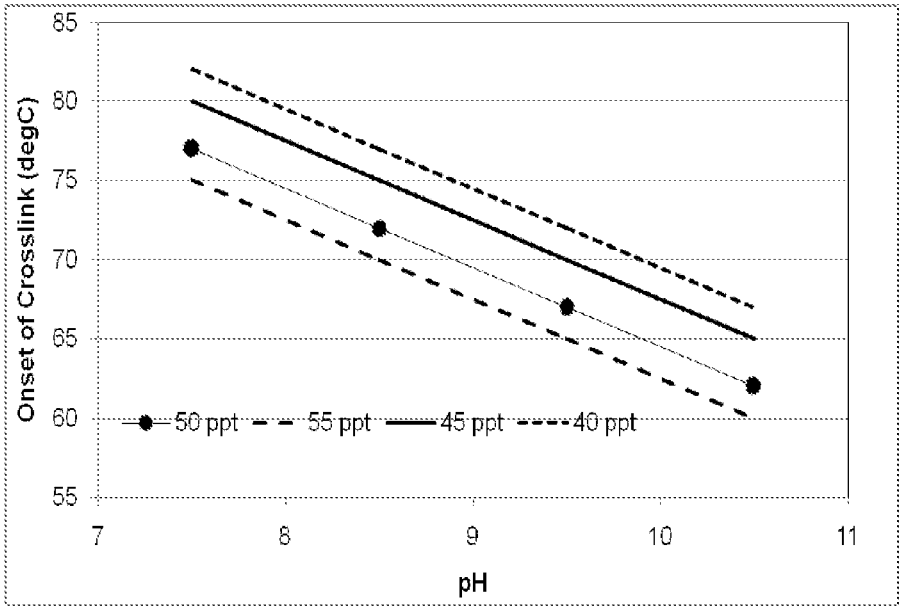
FIG. 16 is a sensitivity plot for the onset of crosslinking temperature as a function of the polymer concentration according to EXAMPLE 3.
Figure 17:
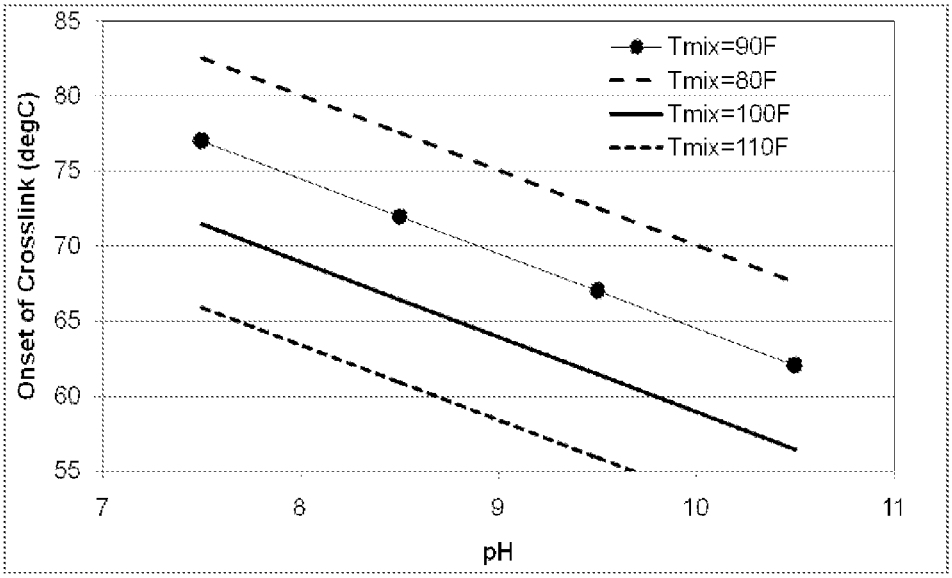
FIG. 17 is a sensitivity plot for the onset of crosslinking temperature as a function of the mix water temperature according to EXAMPLE 3.

In addition the lab provides sensitivity analysis to key variables such as pH, calcium concentration and bicarbonate concentration, polymer concentration, and mix water temperature as per FIGS. 15, 16, and 17, respectively. A recommended pH range for the fluid, pH 9.6-10.2, and a suggested crosslink temperature 63° C.-67° C. are also provided.

Example 4

Due to an unforeseen issue during the well perforating and testing, the fracturing treatment is delayed for a week. In order to increase the effectiveness of the operation, it is decided to perform in consecutive days the stimulation of well A and its twin well B located on the same well location, so that the equipment does not need to move from location, and minimize cost of equipment mobilization. Water from a nearby lake is used to fill in 5 additional tanks (T6, T7, T8, T, T10). In the interest of time no water analysis is done, but the temperature of all ten frac tanks is re-tested yielding the results in Table 4.

TABLE 4

| | T1 | T2 | T3 | T4 | T5 | T6 | T7 | T8 | T9 | T10 |
|---|---|---|---|---|---|---|---|---|---|---|
| Tw (deg F.) | 89 | 95 | 91 | 93 | 89 | 105 | 107 | 108 | 106 | 100 |

Onsite QA/QC is performed on samples of water randomly taken from tanks T2, T3, T7 and T10 yielding the results in Table 5. Due to the small difference between district lab and onsite QA/QC it is decided to increase slightly the activator concentration to 2.75 gpt in order to increase the pH, and bring it closer to the target value of 10.2, and to request rheology confirmation from the district lab. A 50/50 sample of water from tank 2 and tank 7 is sent urgently to the district. The lab reports a pH of 10.2 and a Crosslink temperature of 64° C. at a temperature of 87° F. and a rheology confirmation is submitted electronically, but too late to start the treatment on the day, and a decision is made to postpone the treatment of well A and well B to the next day.

TABLE 5

| TANK | XLT | pH |
|---|---|---|
| 2 | 61 | 9.8 |
| 3 | 62 | 9.9 |
| 7 | 64 | 10 |
| 10 | 64 | 9.8 |

Example 5

Figure 18:
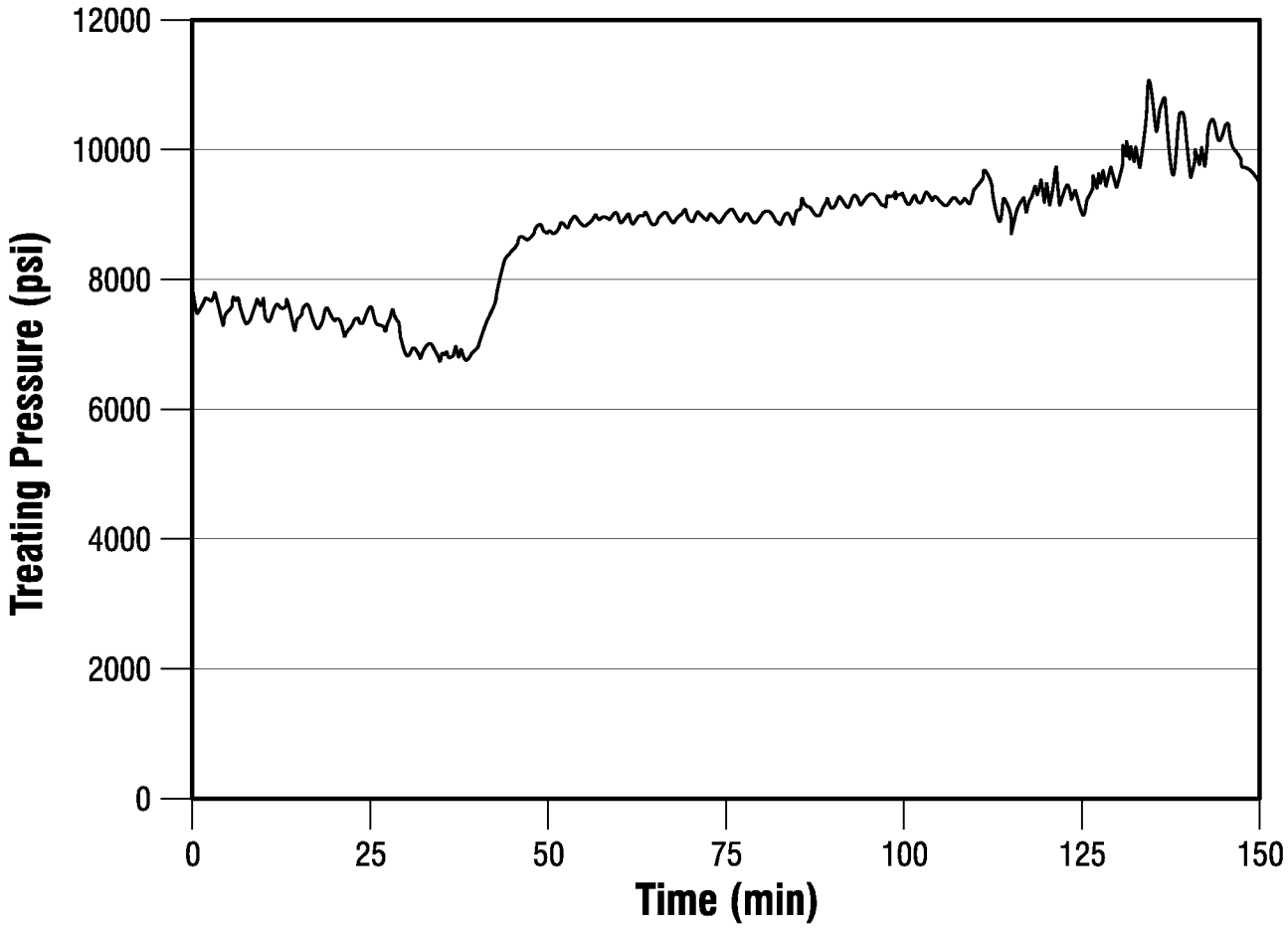
FIG. 18 is a detailed plot of the measured treatment pressure for a hydraulic fracturing treatment according to EXAMPLE 5.

This Example describes the chemical information available for decision making during the treatment in the absence of a model, such as described in this disclosure, and a possible outcome of such decision making process. In the morning it is found that tanks 1 and 3 had suffered substantial water volume losses due to leaking valves, with only 35% of the volume remaining in those tanks A decision is made to start the treatment with the water from tanks 1 and 3, in order to empty them completely and repair the valves while the treatment for well A is being executed, and in order to refill those two tanks with lake water in time for treatment of well B, and subsequently continue the treatment with water from tanks 2, 4, 5, 6, 7, 8, 9 and 10. Treatment is started and samples of the fluid taken at roughly 10 minutes intervals for qualitative monitoring of the fluid quality during the treatment. FIG. 18 shows the pressure observed at surface. Table 6 contains the data obtained during the QA evaluation.

TABLE 6

| TIME | XLT (deg C.) | pH |
|---|---|---|
| 0 | 63 | 10.3 |
| 10 | 65 | 10.1 |
| 20 | 67 | 10.2 |
| 30 | 65 | 10.2 |
| 50 | 59 | 10.3 |
| 80 | 58 | 10.5 |
| 100 | 60 | 10.5 |
| 110 | 57 | 10.5 |
| 125 | 50 | 10.5 |

Figure 19:
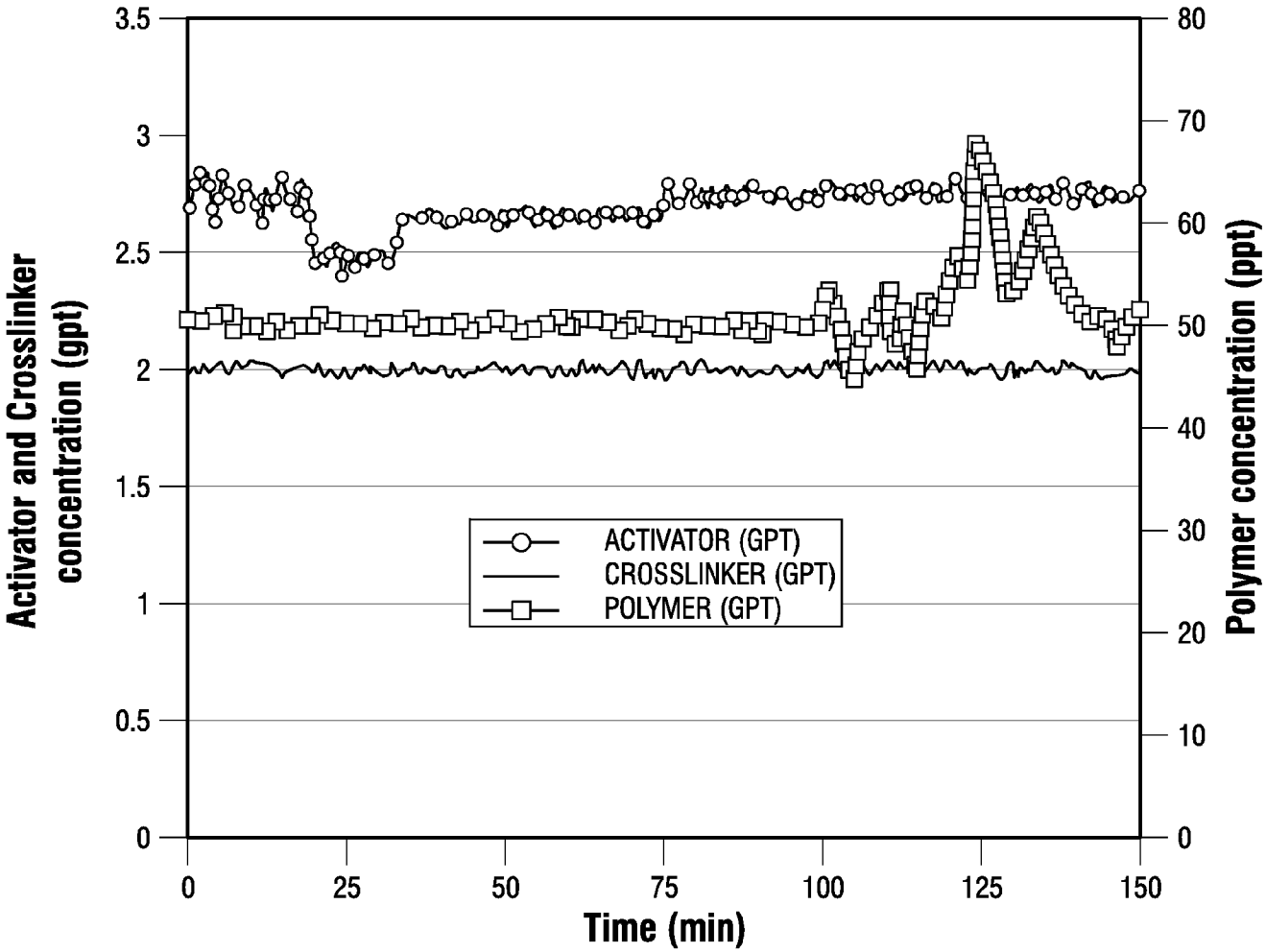
FIG. 19 is a detailed plot of the flow rates for the additives used for a hydraulic fracturing treatment as pumped according to EXAMPLE 5.

At 141 minutes, and based on the observed pressure trace, the field supervisor alters the planned treatment schedule, initiating an early wellbore flush anticipating a potential screen out. As a result, all proppant already in the pipe is displaced into the fracture, and the screen out is avoided. Early analysis of the pressure response concludes that the formation requires higher viscosity for effective fracturing, and the design is modified accordingly, resulting in new lab tests, and a delayed treatment for well B, equipment mobilization, and additional cost. Given the information readily available at the disposal of the control room, one might have continued the treatment, finally resulting in a screenout, and needing an additional workover job, which would results in higher cost, lower revenue, and loss time. FIG. 19 shows the chemical information available to the supervisor for decision making during the treatment during current treatments in the absence of models such as the ones disclosed.

Example 6

Figure 20:
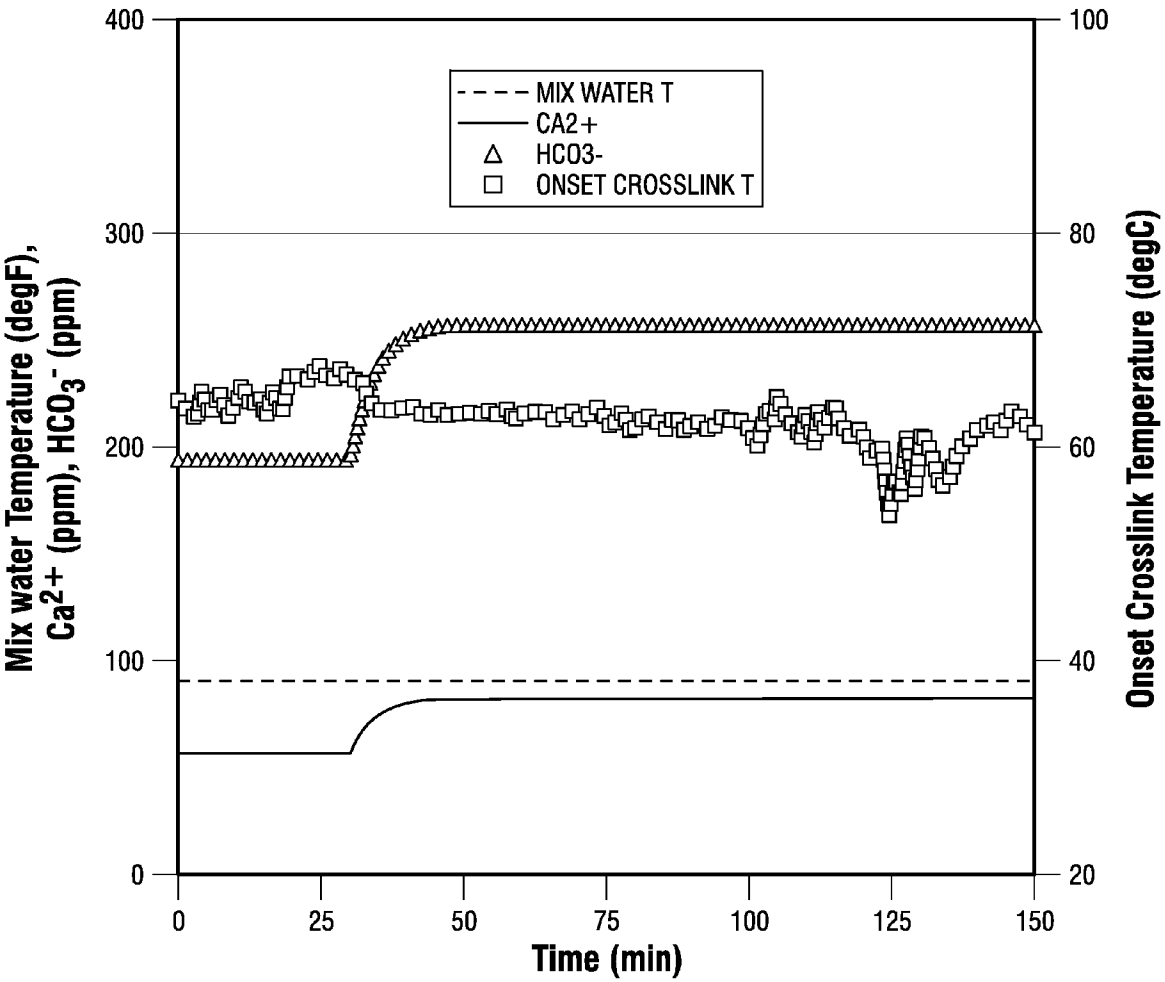
FIG. 20 is a detailed plot of simulated variables for a hydraulic fracturing treatment according to EXAMPLE 6.

In an alternative execution for the treatment of Well A with an open loop control through the use of a chemo-mathematical model as described per FIG. 4, where no additional online measurements were provided, and no water analysis for tanks 6, 7, 8, 9, and 10 is performed prior to the treatment. The chemo-mathematical model used in this example includes the following desired variables Ydes(t): crosslinking temperature, viscosity at surface, viscosity at bottom hole, and friction pressure. Equations required to calculate these variables are heat and mass balances for polymer, crosslinker, activator, empirical balances for fluid rheology and pH. As a first step the job design is run in open loop, pre real job execution. FIG. 20 shows the chemical knowledge acquired pre job by running the model SIMUL as a feed-forward chemo-mathematical control mechanism. From FIG. 20 it is observed that the model accounts for the change in water variables such as temperature, calcium and bicarbonate concentration that will occur during the treatment due to the decisions made for the water source, which in turn enables one to understand and predict a significant change in the fluid properties (rheology) at the time the water source is changed from tanks 1 and 3 to the remaining tanks Running such model SIMUL pre-job, allows for anticipating that a simple change of activator concentration at the time of the water tank change can be effective to maintain the fluid viscosity at the designed level.

Example 7

Figure 21:
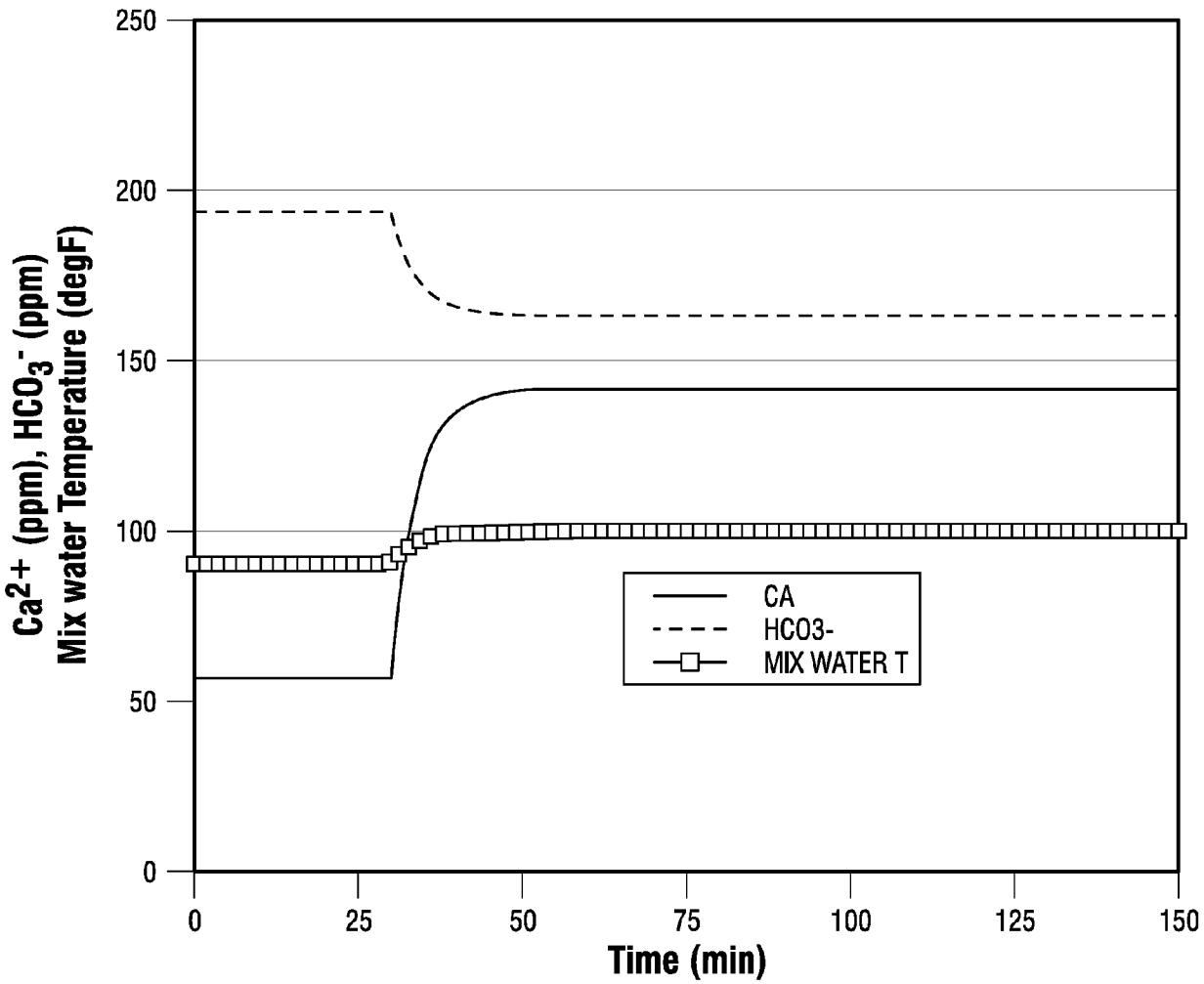
FIG. 21 is a detailed plot of simulated variables for a hydraulic fracturing treatment according to EXAMPLE 7.

Based on the simulation run in Example 6, it is established that the variability of the water quality from the various tanks can substantially affect the deployment of the treatment. Accordingly it is decided to run a new water analysis including all tanks yielding the results in Table 7. In addition to a significant increase of the concentration of calcium in the mix water, which was not considered in Examples 5 and 6, a higher mix water temperature than used for the preliminary rheology determinations and formulation design is observed. Subsequently a new open loop simulation is run as per FIG. 21. In this case the effect of the water chemical composition and the mix water temperature on the effectiveness of the treatment is ascertained, by means of the estimation of the same parameters Ydes(t) described in Example 6. As a result of the simulations it is suggested that the catalyst concentration be further decreased for the whole treatment, in order to generate the preferred viscosity profile, since the effect of the higher mix water temperature on the crosslinking temperature is predicted to substantially decrease the crosslinking temperature, and as a result to increase the friction pressure, what in turn limits the potential for total treatment rate increase if required or appropriate.

TABLE 7

| | T6 | T7 | T8 | t9 | T10 |
|---|---|---|---|---|---|
| $HCO_3^-$ (ppm) | 102 | 57 | 93 | 85 | 72 |
| $Ca^{2+}$ (ppm) | 287 | 203 | 198 | 243 | 235 |
| $Fe^{3+}$ (ppm) | 15 | 13 | 21 | 16 | 11 |
| Si (ppm) | 12 | 7 | 5 | 3 | 6 |
| T (deg F.) | 105 | 107 | 108 | 106 | 100 |

Example 8

Figure 22:
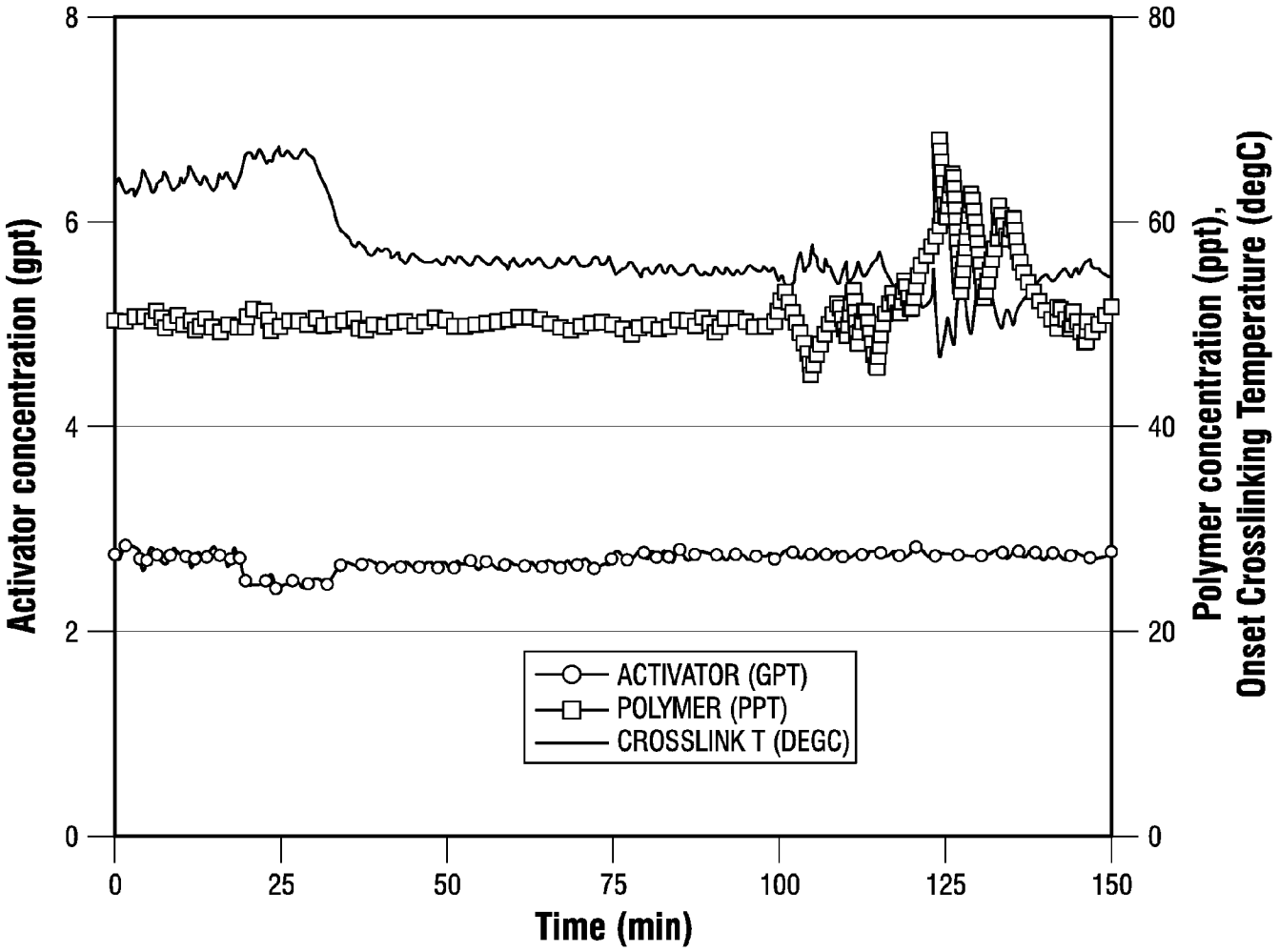
FIG. 22 is a detailed plot of simulated variables for a hydraulic fracturing treatment according to EXAMPLE 8.
Figure 23:
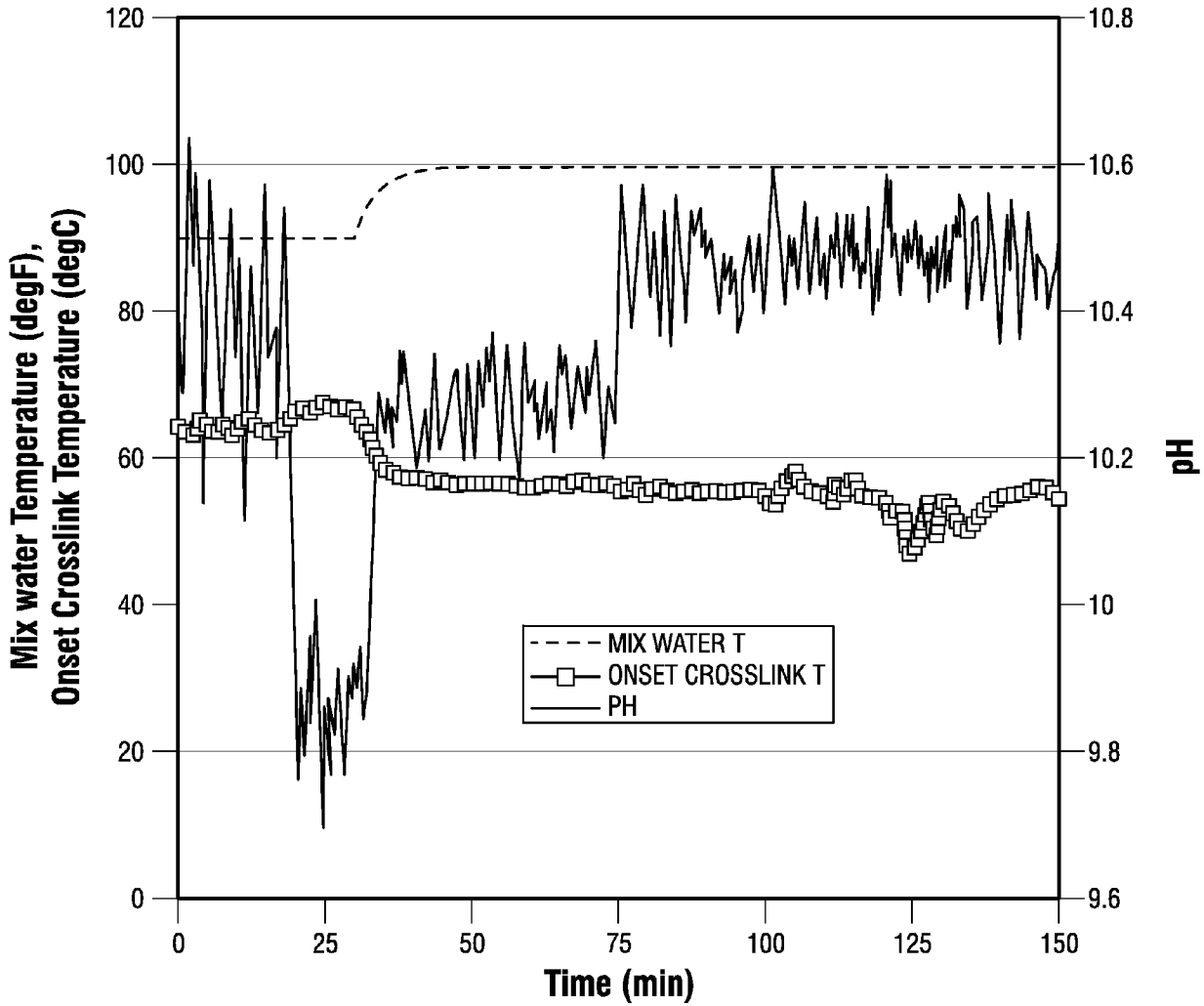
FIG. 23 is a detailed plot of simulated variables for a hydraulic fracturing treatment according to EXAMPLE 8.
Figure 24:
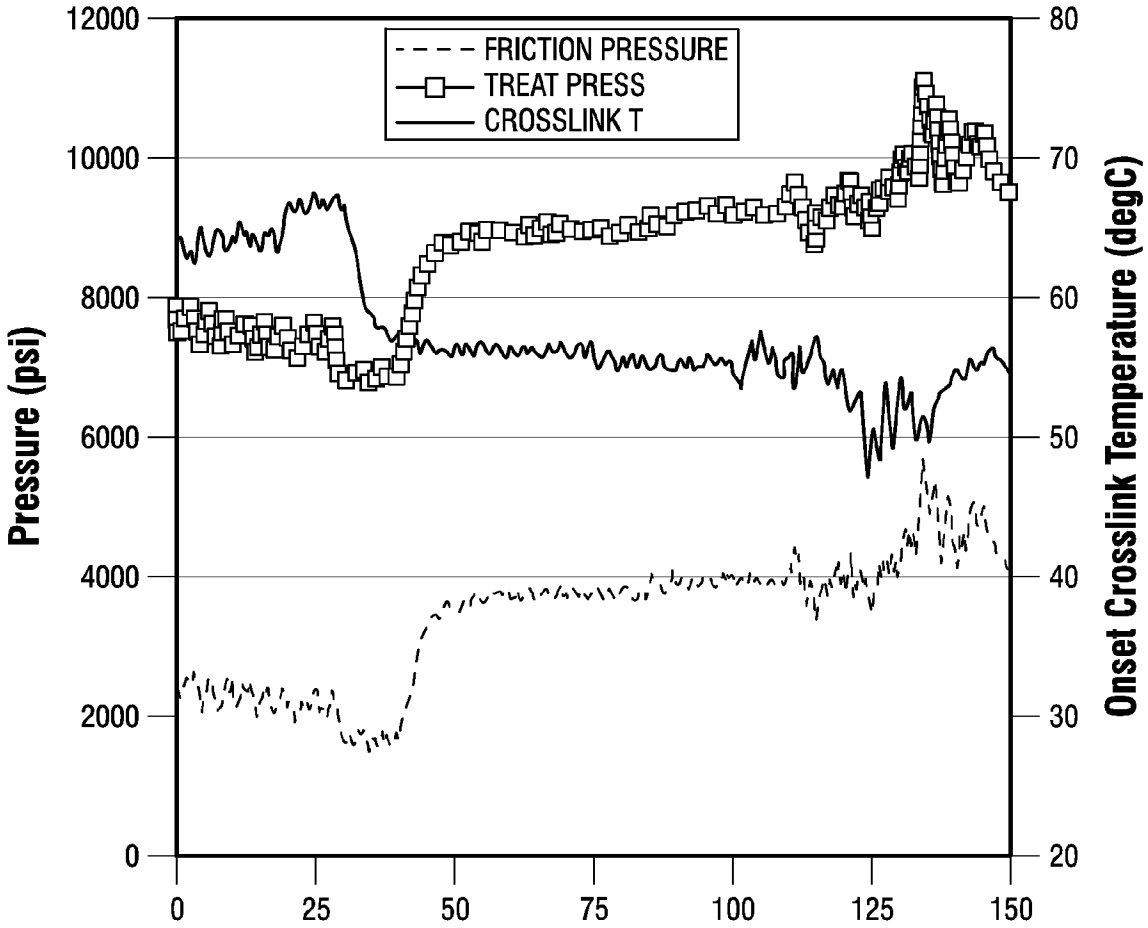
FIG. 24 is a detailed plot of simulated variables for a hydraulic fracturing treatment according to EXAMPLE 8.

As described in Example 7, a prejob run of the model SIMUL can allow for the early detection of expected changes in the treatment due to changes in the environment (raw materials, equipment on location, mix water, ambient temperature), and a better pre-job selection of the different desired control variables set points XdesSP(t). On the other hand a real time run of the model simultaneously with the treatment as described in FIG. 8 can improve the insight during the treatment, and foresee the implications in the "future" of the treatment that are related to chemical composition, and decouple these from those mechanical and derived from the formation response to the treatment, as a response of the events that actually happen during the treatment. A model EXEC with similar calculations to those performed by the model SIMUL in Example 7 is executed simultaneously with the treatment, incorporating the actual values of each of the liquid and solid addition rates as measured during the treatment. FIGS. 22, 23 and 24 show the realtime simulation by the model EXEC, and the values of the different desired variables Ydes(t) obtained during the simulation. It is observed that including the variations on the concentration of activator due to a minor activator pump failure allows for a better prediction of the fluid pH, the crosslinking temperature, and the fluid friction during the pad stage. In addition, it is shown that the response of the fluid to the changes in mix water composition are also predicted, and finally, the change of treatment pressure observed, is traced back to an increase of friction pressure, caused by the increase of fluid viscosity due to the decrease of crosslinking temperature predicted, when the average polymer concentration began drifting, and the activator concentration (and the crosslinker), were maintained proportional to the polymer concentration. In summary, running the model EXEC simultaneously with the process can enable correlation of changes in crosslinking temperature and fluid viscosity to changes in the treatment pressure.

Example 9

Figure 25:
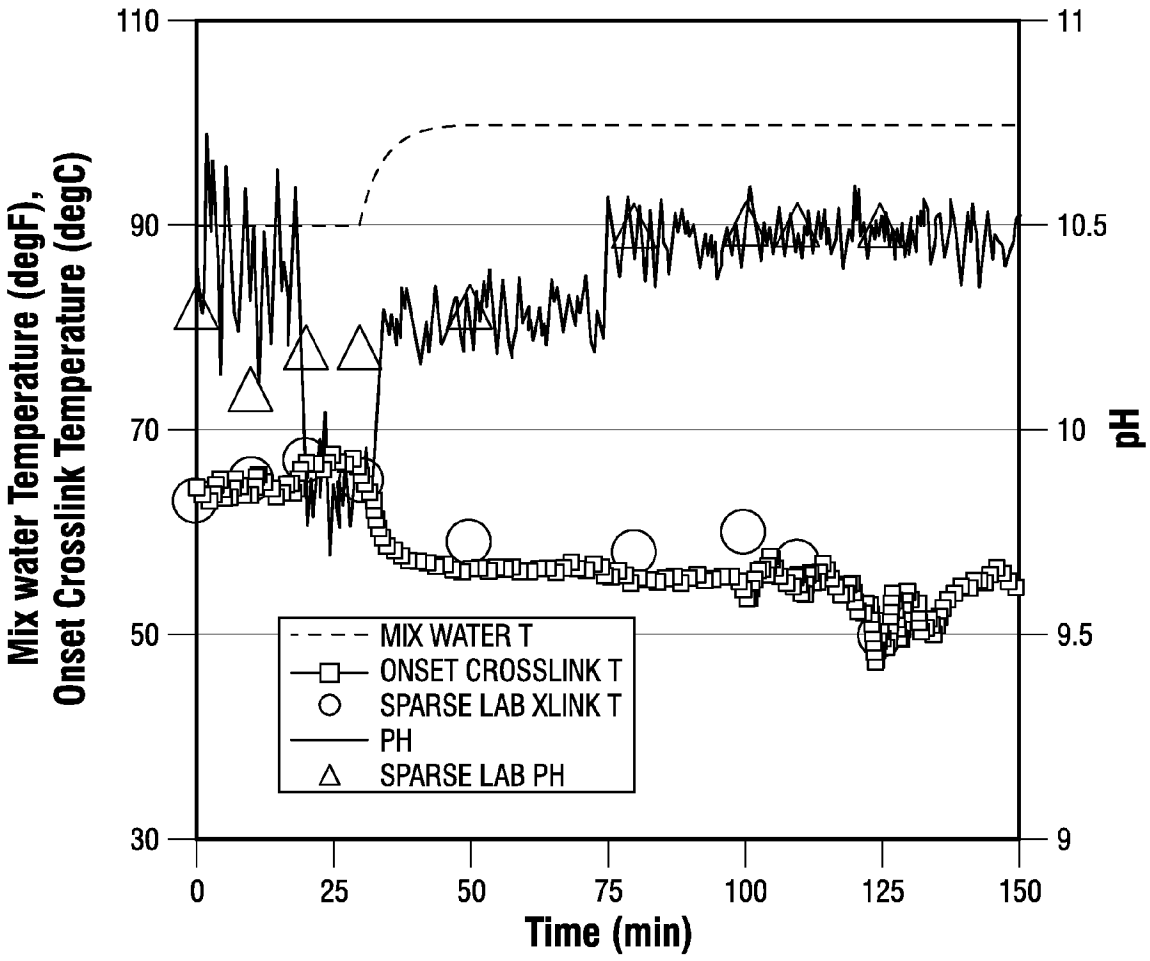
FIG. 25 is a detailed plot of simulated variables for a hydraulic fracturing treatment according to EXAMPLE 9.

Introducing a series of sparse measurements such as offline crosslinking temperature measurements during the process can facilitate accelerating the early detection of problems during the treatment, but such sparse measurements in isolation cannot provide a good assessment of the causes of the changes observed. When such sparse measurements are introduced and compared to the predictions of the model EXEC, the problem detection is accelerated, as well as the root cause analysis, enabling faster decision making FIG. 25 shows how the dynamic estimation of crosslinking temperature provided by the model EXEC can be verified, and the experimental error minimized by coupling both experimental determination and model predictions. The sparse experimental data presented are the values provided by the laboratory during the treatment. In addition the sparse experimental measurements can be used to calibrate the online estimator for small off-sets that can be created by small miss-alignment of the equations to the experimental data the required parameter of the model are fitted with.

Example 10

Figure 26:
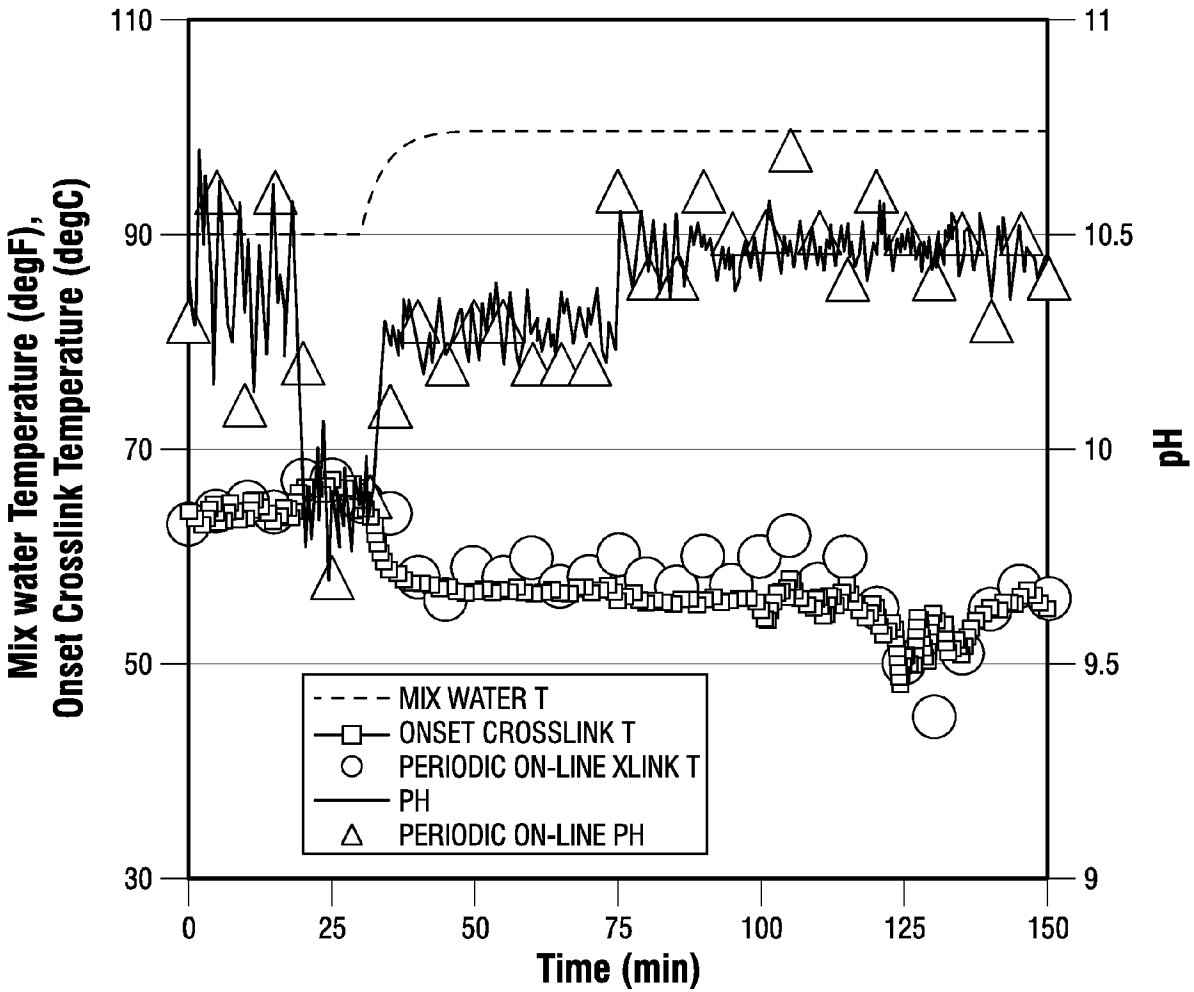
FIG. 26 is a detailed plot of simulated variables for a hydraulic fracturing treatment according to EXAMPLE 10.

Further improvements can be obtained by introducing a series of periodical measurements such as those obtained by placing a robust rheometer in line during the treatment and performing periodical determinations of the crosslinking temperature by means of dynamic measurements similar to those described in the disclosure. Alternatively similar information could be obtained by performing periodical determinations of the crosslinking temperature by means of dynamic measurements on an off-line robust rheometer in the treatment QA/QC lab on samples obtained at predetermined intervals. Performing such periodical measurements during the process can further facilitate accelerating the early detection of problems during the treatment, but such periodical measurements in isolation may not provide a good assessment of the cause of the changes observed. When such periodical measurements are introduced and compared to the predictions of the model EXEC, the problem detection is accelerated, as well as the root cause analysis, enabling faster decision making FIG. 26 shows how the dynamic estimation of crosslinking temperature provided by the model EXEC that can be further improved, and the experimental error minimized by coupling both experimental determination and model predictions. The periodical experimental data presented are simulated online measurements during the treatment. In addition the periodical experimental measurements can be used to calibrate the online estimator for small off-sets that can be created by small miss-alignment of the equations to the experimental data the required parameter of the model are fitted with.

Example 11

Further improvements can be obtained by introducing continuous chemical on-line measurements such as those obtained by placing robust probes in line during the treatment and performing continuous determinations of chemical composition measurements by means of said probes. One such measurement of interest is fluid pH. In typical stimulation fluids, pH affects the majority of the chemical reactions and equilibria such as hydration, precipitation, extent of crosslinking, crosslinking delay and rate of break. Several of the components introduced in a stimulation treatment have to some degree an acidic or basic nature. In addition, various acids and bases can be incorporated with the mix water, and therefore its concentration cannot be fully controlled, or properly measured. pH calculation is one of the variables that can be estimated with the SIMUL and EXEC models. Performing continuous measurements of pH during the process can further help accelerating the early detection of problems during the treatment. When such continuous measurements are introduced and compared to the predictions of the model EXEC, the problem detection is accelerated, as well as the root cause analysis, enabling faster decision making. The pH estimation provided by the model EXEC that can be further improved, and the experimental error minimized by coupling both experimental determination and model predictions. In addition continuous experimental measurements can be used to calibrate the online estimator for small off-sets that can be created by small miss-alignment of the equations to the experimental data the required parameter of the model are fitted with.

Example 12

Figure 27:
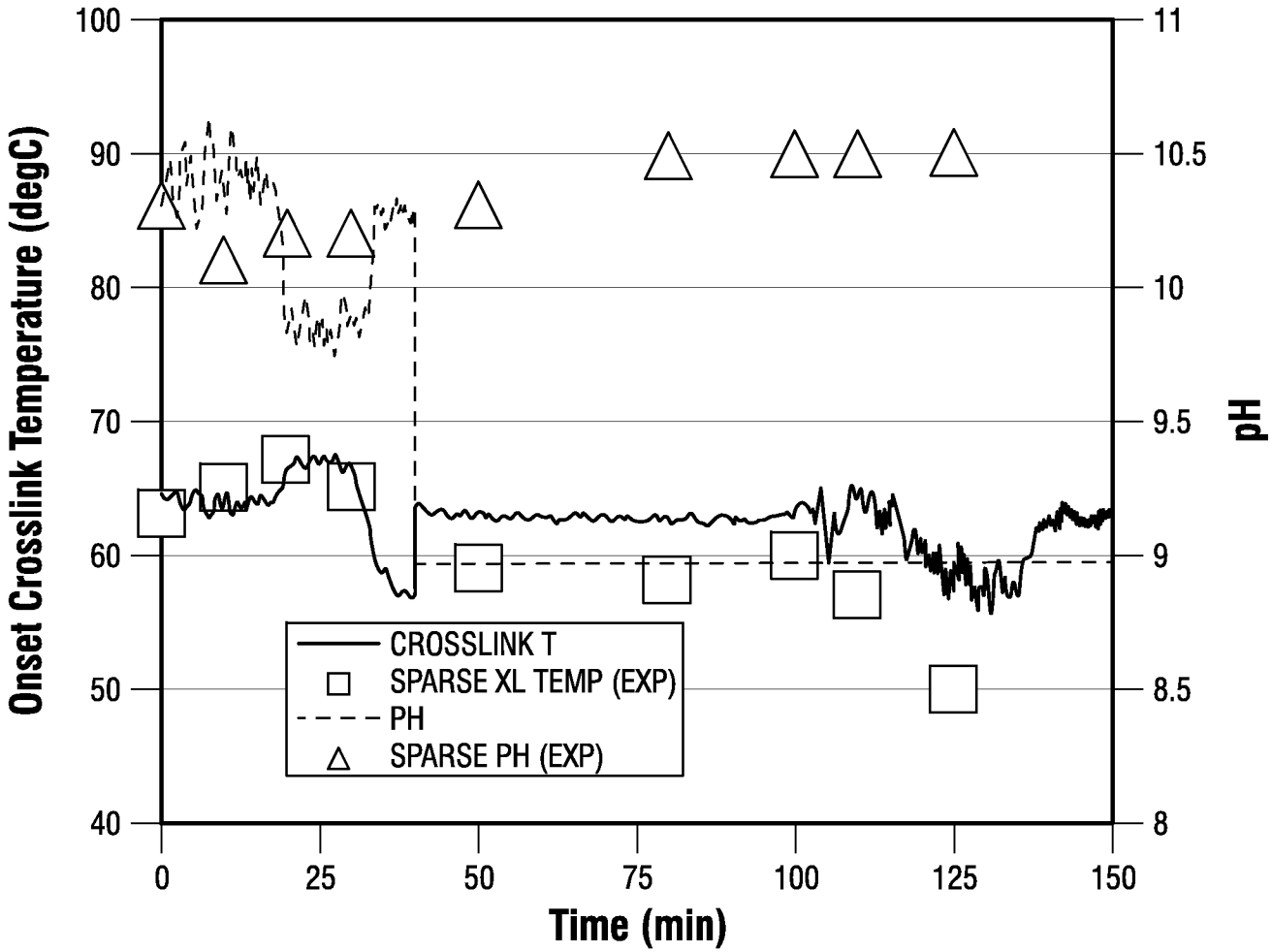
FIG. 27 is a detailed plot of simulated variables for a hydraulic fracturing treatment according to EXAMPLE 12.
Figure 28:
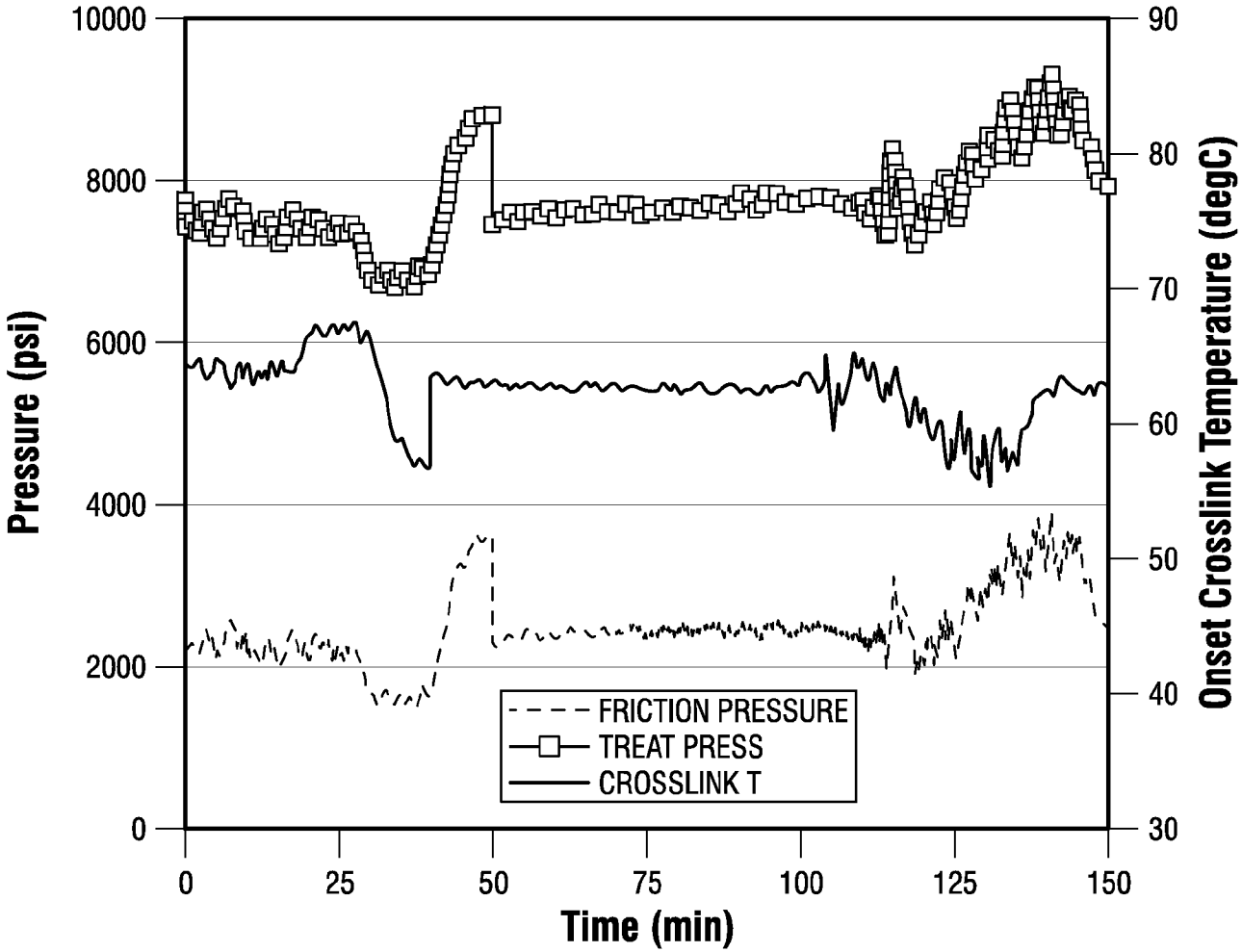
FIG. 28 is a detailed plot of simulated variables for a hydraulic fracturing treatment according to EXAMPLE 12.

Optimum control of the stimulation treatment can be achieved when a closed loop control of the chemical formulation is provided. FIG. 27 depicts the control actions for the activator concentration as required to maintain the process in control and the crosslinking temperature at the desired value as determined by the closed-loop control strategy depicted in FIG. 10, which is proposed for the treatment of Well A given that only the sparse measurements performed during the treatment are available. Similarly FIG. 28 shows that a much better control of the friction pressure, is achieved when the fluid pH is maintained throughout the treatment keeping those key variables within the control limits.

Example 13

Figure 29:
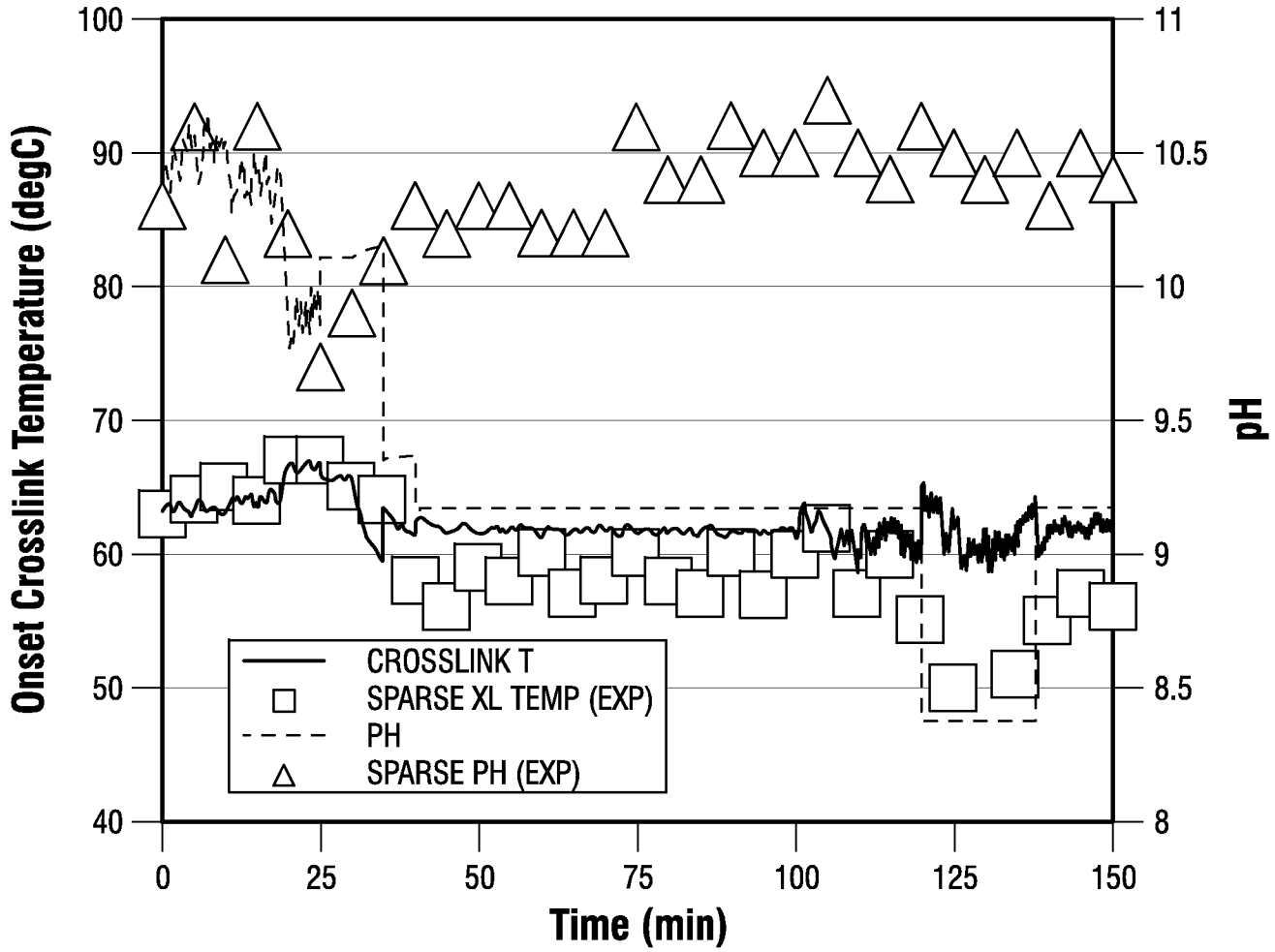
FIG. 29 is a detailed plot of simulated variables for a hydraulic fracturing treatment according to EXAMPLE 13.
Figure 30:
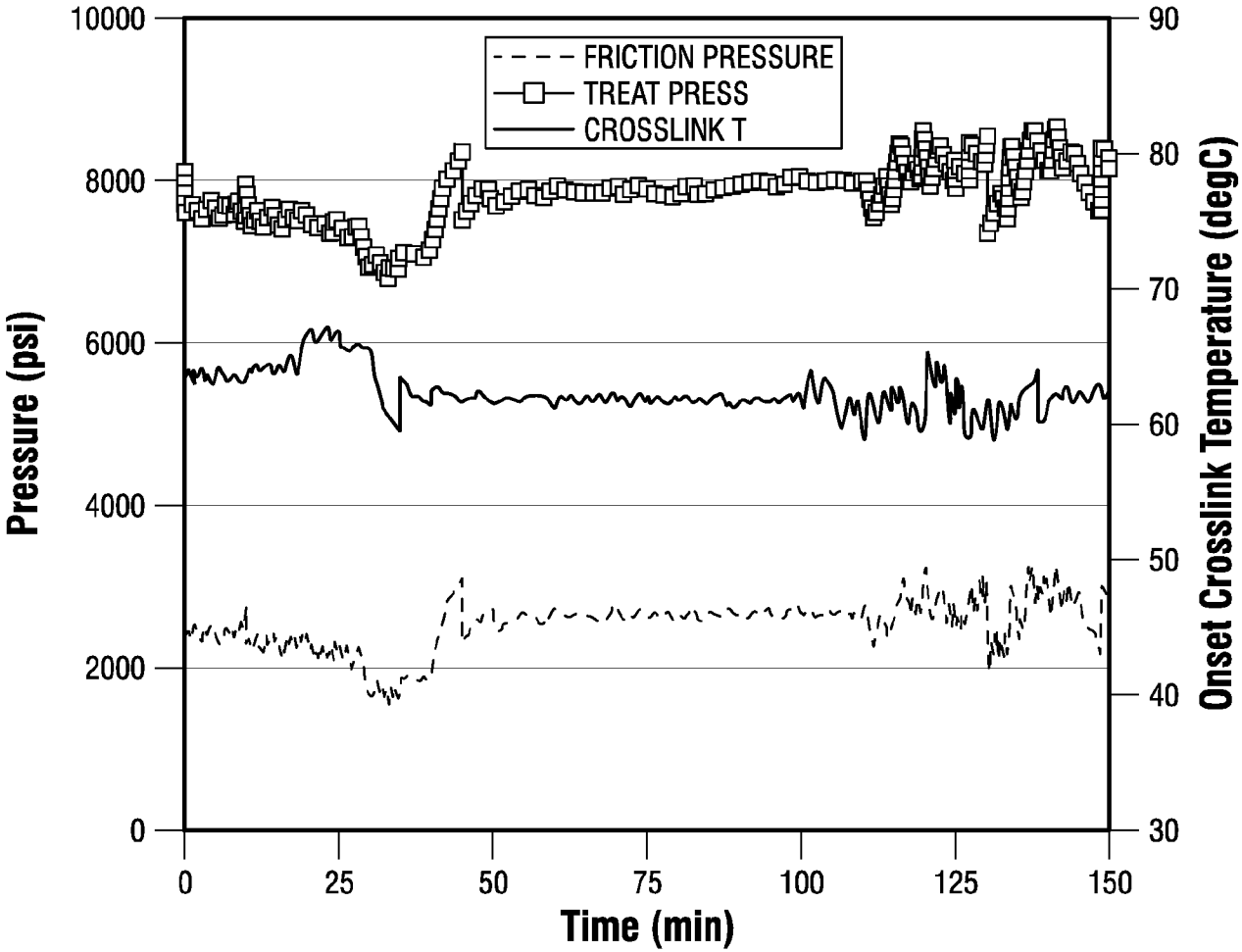
FIG. 30 is a detailed plot of simulated variables for a hydraulic fracturing treatment according to EXAMPLE 13.

Even better control of the stimulation treatment can be achieved when a closed loop control of the chemical formulation is provided, and on-line (periodical and or continuous) measurements of the process are provided. FIG. 29 depicts the control actions for the activator concentration as required to maintain the process in control and the crosslinking temperature at the desired value as determined by the closed-loop control strategy depicted in FIG. 10, which is proposed for the treatment of Well A given that periodical measurements of crosslinking temperature measurements performed online during the treatment, and continuous measurement of pH are available. Similarly FIG. 30 shows that a much better control of the friction pressure, is achieved when the fluid pH and the crosslinking temperature are maintained throughout the treatment keeping those key variables within the control limits. It will be understood from the example that the identification of chemical changes and execution of control actions as a response is a powerful method to optimize treatment in addition to understanding formation responses. Having periodic measurements to validate the prediction of onset temperature to crosslink as a result of the polymer concentration increase, can also help to further understand the reason for the observed treating pressure increase. Additional control actions can be taken as shown in FIG. 29, as a response to the polymer concentration increase, resulting in a very minor friction pressure increase. Had the model presented in this example been available during the treatment of Example 5, the pressure increase in surface would have been easily recognized by means of the simulated crosslink temperature, ion concentrations, fluid temperature, and estimated pH, as the result of a combination of too high polymer, catalyst, surface mix water temperature and ionic strength, appropriate control measurements would have been taken, and the treatment would have gone to completion.

Those skilled in the art would understand that, while borate and zirconate crosslinked polymer based fracturing fluids have been considered for the exemplification and clarification of the disclosure, similar chemical processes can be found in many oilfield well stimulation and well intervention treatments, and thus similar equations can be written, and similar methods as those described in the invention, can be employed to control other oilfield servicing treatments, and in addition to provide formation related insight as a response to maintaining the chemical formulations in control.

In most cases the additive fluid streams constitute the controlled or actionable variables. Control of such streams can be made by adjusting the flow rates through the use of suitable pumping controls or control valves for the various additive streams. In certain instances, control or regulation of the mix water or solvent or carrier fluid stream may also be used. By using the above-described methods, the properties of the treatment fluid can be altered or modified during the treatment to account for uncontrollable variables or noise, to provide a more effective treatment fluid having properties that are closer to the intended design properties or that take into account uncontrollable variables that may have changed from what was used in the initial design. The methodology provides generally real-time control and adjustment based upon chemical and fluid properties that heretofore have not been taken into account in fracturing and other oil and gas well treatments. Additionally, because of the nature of well treatments, it is often difficult to determine what one variable in the treatment may be causing a particular problem, irregularity or issue during the treatment. By continuously monitoring the fluid properties and making adjustments as needed, one can eliminate the fluid properties or chemistry as a possible cause or source of such problems or other issues so that other variables may be investigated or address to thereby improve the treatment.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. An intervention method of treating a subterranean formation penetrated by a wellbore, the method comprising:

providing a carrier fluid stream;

providing at least one additive fluid stream;

providing at least one solid material stream;

preparing a single treatment fluid at a surface location based upon an initial model of fluid properties for the single treatment fluid, the single treatment fluid comprising the carrier fluid stream, the additive fluid stream and the solid material stream;

introducing the single treatment fluid by a single treatment fluid stream into the wellbore in a substantially continuous process during a duration of a well intervention operation;

monitoring a fluid property of at least one of the carrier fluid stream, the additive fluid stream, the solid material stream and the single treatment fluid stream, while forming the single treatment fluid, wherein the fluid property is monitored before the treatment fluid reaches the subterranean formation;

providing at least one monitored fluid property of the carrier fluid stream, the additive fluid stream, the solid material stream and the single treatment fluid stream;

updating the model based upon the at least one monitored fluid property during the substantially continuous process; and adjusting at least one of the carrier fluid stream, the additive fluid stream, the solid material stream and the single treatment fluid stream, based upon the updated model to form an adjusted treatment fluid stream, contacting the adjusted treatment fluid stream with the subterranean formation;

wherein the monitored fluid property comprises at least one property selected from the group consisting of pH, temperature, simple shear viscosity, complex viscosity, loss modulus, complex modulus, elastic modulus, loss tangent, tan δ, fluid density, chemical composition, addition rate, additive concentration, degree of crosslinking, additive molecular weight, onset temperature for crosslinking, fluid thermal thinning, proppant settling velocity, pressure, UV, IR, NIR, and Raman spectroscopic measurements, and wherein the single treatment fluid is selected from the group consisting of a hydraulic fracturing fluid, an acid fracturing fluid, an acid diverting fluid, a matrix acidizing fluid, a sandstone acidizing fluid, a sand control treatment fluid, a wellbore consolidation treatment fluid, a cementing treatment fluid, a water control treatment fluid, a remediation treatment fluid, a polymer fracturing fluid, a crosslinked polymer fracturing fluid, a foamed fracturing fluids, an emulsion fracturing fluid, a slick water fracturing fluid, a bull heading acid formulation, an organic clay acid treatment fluid, a sand consolidation treatment fluid, and a diversion treatment fluid.

2. The method of claim 1, wherein:

the monitoring of at least one of the streams is conducted substantially continuously.

3. The method of claim 1, wherein:

the monitoring of at least one of the streams is conducted periodically using dynamic rheology analysis.

4. The method of claim 3, wherein:

the dynamic rheology analysis is conducted off-line.

5. The method of claim 3, wherein:

the dynamic rheology analysis is conducted on-line.

6. The method of claim 1, wherein:

the monitoring of the fluid property of the at least one of the streams is carried out periodically; and further comprising providing a prediction of a fluid property for at least one of the fluid streams based upon fluid modeling and the periodically monitored fluid property and providing an estimate of a fluid property for at least one of the fluid streams.

7. The method of claim 6, wherein:

the adjusting is based upon a comparison of the updated model and the estimate of the fluid property.

8. The method of claim 1, wherein:

there are a plurality of additive fluid streams.

9. The method of claim 1, wherein:

the at least one additive fluid stream is selected from at least one of a viscosifying agent stream, a proppant stream, a crosslinking agent stream, a crosslinking activator stream, an oxygen scavenging stream, a crosslinking delay agent stream, a solid polymer stream, a slurried polymer stream, a resin stream, a fines migration additive stream, a fiber stream, a resin coated proppant stream, a corrosion inhibitor stream, a friction reducer stream, a clay control additive stream, an organic scale control stream, a flow back additive stream, a microemulsion stream, a foamer stream, a gas stream, an immiscible liquid stream, an acid, a base, a chelating agent, a wetting agent, a viscoelastic surfactant gelling stream, a diverter stream, a breaker activator, a breaker retarder, a biocide, and a breaker stream.

10. The method of claim 1, wherein:

monitoring the fluid property occurs at at least one of a point of introduction of a fluid stream, an outlet, a point of mixing of at least two different fluid streams, the well head, a selected depth within the wellbore, a perforated zone of the wellbore and a position within a fracture of the subterranean formation.

11. An intervention method of treating a subterranean formation penetrated by a wellbore, the method comprising:

providing a carrier fluid stream;

providing at least one additive fluid stream;

providing at least one solid material stream;

preparing a single treatment fluid at a surface location based upon an initial model of fluid properties for the single treatment fluid, the single treatment fluid comprising the carrier fluid stream, the additive fluid stream and the solid material stream;

introducing the single treatment fluid by a single treatment fluid stream into the wellbore in a substantially continuous process during a duration of a well intervention operation;

substantially continuously monitoring a fluid property of at least one of carrier fluid stream, the additive fluid stream, the solid material stream and the single treatment fluid stream, while forming the single treatment fluid, wherein the fluid property is substantially continuously monitored before the single treatment fluid reaches the subterranean formation;

providing at least one monitored fluid property of the carrier fluid stream, the additive fluid stream, the solid material stream and the single treatment fluid stream;

updating the model based upon the at least one monitored fluid property during the substantially continuous process;

performing a periodic monitoring of the fluid property of the at least one of the streams that is separate from the substantially continuously monitoring of the fluid property;

providing a prediction of the fluid property for at least one of the fluid streams based upon the updated model and the periodically monitored fluid property and providing an estimate of a fluid property for at least one of the fluid streams; and adjusting at least one of the carrier fluid stream, the additive fluid stream, the solid material stream and the single treatment fluid stream, based upon a comparison of the updated model and the estimate of the fluid property, contacting the adjusted treatment fluid stream with the subterranean formation;

wherein the monitored fluid property comprises at least one property selected from the group consisting of pH, temperature, simple shear viscosity, complex viscosity, loss modulus, complex modulus, elastic modulus, loss tangent, tan δ, fluid density, chemical composition, addition rate, additive concentration, degree of crosslinking, additive molecular weight, onset temperature for crosslinking, fluid thermal thinning, proppant settling velocity, pressure, UV, IR, NIR, and Raman spectroscopic measurements, and wherein the single treatment fluid is selected from the group consisting of a hydraulic fracturing fluid, an acid fracturing fluid, an acid diverting fluid, a matrix acidizing fluid, a sandstone acidizing fluid, a sand control treatment fluid, a wellbore consolidation treatment fluid, a cementing treatment fluid, a water control treatment fluid, a remediation treatment fluid, a polymer fracturing fluid, a crosslinked polymer fracturing fluid, a foamed fracturing fluids, an emulsion fracturing fluid, a slick water fracturing fluid, a bull heading acid formulation, an organic clay acid treatment fluid, a sand consolidation treatment fluid, and a diversion treatment fluid.

12. The method of claim 11, wherein:

the substantially continuously monitoring is conducted using dynamic rheology analysis.

13. The method of claim 11, wherein:

the periodic monitoring is conducted using dynamic rheology analysis.

14. The method of claim 13, wherein:

the dynamic rheology analysis is conducted off-line.

15. The method of claim 13, wherein:

the dynamic rheology analysis is conducted on-line.

16. The method of claim 11, wherein:

there are a plurality of additive fluid streams.

17. The method of claim 11, wherein:

monitoring the fluid property occurs at at least one of a point of introduction of a fluid stream, an outlet, a point of mixing of at least two different fluid streams, the well head, a selected depth within the wellbore, a perforated zone of the wellbore and a position within a fracture of the subterranean formation.

18. An intervention method of treating a subterranean formation penetrated by a wellbore, the method comprising:

providing a carrier fluid stream;

providing at least one additive fluid stream selected from at least one of a viscosifying agent stream, a proppant stream, a crosslinking agent stream, a crosslinking activator stream, an oxygen scavenging stream, a crosslinking delay agent stream, a solid polymer stream, a slurried polymer stream, a resin stream, a fines migration additive stream, a fiber stream, a resin coated proppant stream, a corrosion inhibitor stream, a friction reducer stream, a clay control additive stream, an organic scale control stream, a flow back additive stream, a microemulsion stream, a foamer stream, a gas stream, an immiscible liquid stream, an acid, a base, a chelating agent, a wetting agent, a viscoelastic surfactant gelling stream, a diverter stream, a breaker activator, a breaker retarder, a biocide, and a breaker stream;

providing at least one solid material stream;

preparing a single treatment fluid at a surface location based upon an initial model of fluid properties for the single treatment fluid, the single treatment fluid comprising the carrier fluid stream, the additive fluid stream and the solid material stream;

introducing the single treatment fluid by a single treatment fluid stream into the wellbore in a substantially continuous process during a duration of a well intervention operation, substantially continuously monitoring a fluid property of at least one of the carrier fluid stream, the additive fluid stream, the solid material stream and the single treatment fluid stream, while forming the single treatment fluid, wherein the monitored fluid property comprising at least one of pH, temperature, simple shear viscosity, complex viscosity, loss modulus, complex modulus, elastic modulus, loss tangent, tan δ, fluid density, chemical composition, addition rate, additive concentration, degree of crosslinking, additive molecular weight, onset temperature for crosslinking, fluid thermal thinning, proppant settling velocity, pressure, UV, IR, NIR, and Raman spectroscopic measurements, wherein the fluid property is substantially continuously monitored before the single treatment fluid reaches the subterranean formation;

providing at least one monitored fluid property of the carrier fluid stream, the additive fluid stream, the solid material stream and the single treatment fluid stream;

updating the model based upon the at least one monitored fluid property during the substantially continuous process;

performing a periodic monitoring of the fluid property of the at least one of the streams that is separate from the substantially continuously monitoring of the fluid property;

providing a prediction of the fluid property for at least one of the fluid streams based upon the updated model and the periodically monitored fluid property and providing an estimate of a fluid property for at least one of the fluid streams; and adjusting at least one of the carrier fluid stream, the additive fluid stream, the solid material stream and the single treatment fluid stream, based upon a comparison of the updated model and the estimate of the fluid property, and contacting the adjusted treatment fluid stream with the subterranean formation; and wherein the treatment fluid is selected from the group consisting of a hydraulic fracturing fluid, an acid fracturing fluid, an acid diverting fluid, a matrix acidizing fluid, a sandstone acidizing fluid, a sand control treatment fluid, a wellbore consolidation treatment fluid, a cementing treatment fluid, a water control treatment fluid, a remediation treatment fluid, a polymer fracturing fluid, a crosslinked polymer fracturing fluid, a foamed fracturing fluids, an emulsion fracturing fluid, a slick water fracturing fluid, a bull heading acid formulation, an organic clay acid treatment fluid, a sand consolidation treatment fluid, and a diversion treatment fluid.

* * * * *